US007176873B2

(12) United States Patent
Nakamura et al.

(10) Patent No.: US 7,176,873 B2
(45) **Date of Patent: *Feb. 13, 2007**

(54) DISPLAY DEVICE AND DRIVING METHOD THEREOF

(75) Inventors: Masashi Nakamura, Chosei (JP); Nobuhiro Takeda, Mobara (JP)

(73) Assignee: Hitachi Displays, Ltd., Mobara (JP)

( * ) Notice: Subject to any disclaimer, the term of this patent is extended or adjusted under 35 U.S.C. 154(b) by 342 days.

This patent is subject to a terminal disclaimer.

(21) Appl. No.: 10/787,771

(22) Filed: Feb. 27, 2004

(65) Prior Publication Data

US 2004/0169626 A1 Sep. 2, 2004

(30) Foreign Application Priority Data

Feb. 28, 2003 (JP) ..... 2003-053730

(51) Int. Cl.
*G09G 3/36* (2006.01)
*G09G 5/00* (2006.01)

(52) U.S. Cl. ..... 345/98; 345/96; 345/100; 345/209

(58) Field of Classification Search ..... 345/87–102, 345/204–212; 315/169.1–169.4
See application file for complete search history.

(56) References Cited

U.S. PATENT DOCUMENTS 5,510,805 A * 4/1996 Lee ..... 345/58
5,648,790 A * 7/1997 Lee ..... 345/58
6,448,718 B1 * 9/2002 Battersby ..... 315/169.3
6,882,103 B2 * 4/2005 Kim et al. ..... 313/504

* cited by examiner

*Primary Examiner*—Vijay Shankar
(74) *Attorney, Agent, or Firm*—Antonelli, Terry, Stout and Kraus, LLP.

(57) ABSTRACT

A display device of the present invention prevents the deterioration of display quality even when input video data are changed. In a matrix type display device, lines of video data are inputted to the data driver circuit one after another for every horizontal scanning period of the video data. The data driver circuit alternately repeats (i) a first step for generating a display signal corresponding to each one of the lines of the video data one after another for every fixed period and outputting the display signal to the pixel array N-times (N being a natural number equal to or greater than 2) and (ii) a second step for generating a display signal which makes the luminance of the pixels lower than the luminance of the pixel in the first step for the fixed period and outputting the display signal to the pixel array M-times (M being a natural number smaller than N). The scanning driver circuit alternately repeats (i) a first selection step for selecting the plurality of pixel rows for every Y rows (Y being a natural number smaller than the N/M) sequentially from one end to another end of the pixel array along the second direction in the first step and (ii) a second selection step for selecting the plurality of pixel rows other than the pixel rows (Y×N) selected in the first selection step for every Z rows (Z being a natural number not smaller than N/M) sequentially from one end to another end of the pixel array along the second direction in the second step. Further, the outputting of N pieces of display signals in the first step and the outputting of M pieces of display signals in the second step are performed in response to periods which are obtained by evenly dividing the N-pieces of the horizontal scanning periods which are sequentially outputted into (N+M) pieces of periods.

11 Claims, 7 Drawing Sheets

DISPLAY DEVICE AND DRIVING METHOD THEREOF

BACKGROUND OF THE INVENTION

The present invention relates to a display device, such as an active-matrix type liquid crystal display device, an electroluminescence array or the like, for example.

An active matrix type display device is, for example, configured TO include a pixel array which is formed by arranging a plurality of pixel rows, each of which includes a plurality of pixels that extend in the x direction, so that the rows are arranged in parallel in the y direction; a scanning drive circuit, which sequentially selects the plurality of pixel rows in response to scanning signals; and a data driver circuit, which supplies display signals to the respective pixels included in at least one pixel row selected in response to a scanning signal.

In such a constitution, to make animated images more vivid at the time of displaying the animated images, several attempts have been made to generate a black display of the whole region of a screen over a plurality of frames by sequentially supplying a display signal to several rows (for example, 4 rows) and, thereafter, by supplying, for example, a single blanking data signal to a plurality (for example, 4) of other neighboring rows that are different from the rows to which the display signal is supplied, and such operations are sequentially repeated.

SUMMARY OF THE INVENTION

However, in the above-mentioned display device, the timing for sequentially supplying the display signals to 4 rows, including the above-mentioned single supply of the above-mentioned blanking data signal; is performed in response to pulses that have been obtained on the basis of a value which is obtained by evenly dividing 4 horizontal scanning periods of a horizontal synchronizing signal contained in the video data to be inputted to the display device into 5 sections.

The even division of 4 horizontal periods into 5 sections serves to shorten the retrace periods contained in respective horizontal scanning periods of the video data, thus producing a period for supplying the blanking data. However, it has been found that, since a value used for evenly dividing the 4 horizontal scanning periods into 5 sections is a fixed value, the following drawback arises.

That is, with respect to the video data, when the video data which has been used as data for a personal computer, for example, is changed over to video data for a television receiver set or the like, the cycle of the horizontal synchronizing signal of the video data for the television receiver set is shortened, and 4 horizontal scanning periods of the horizontal synchronizing signal having such a shortened cycle are divided by the above-mentioned value (the fixed value).

Accordingly, assuming that the blanking data is supplied at first and, thereafter, the sequential supply of 4 display signals follows, the time for supplying the fourth display signal is prolonged; and, hence, there arises a phenomenon in which writing of data in the pixel is facilitated compared to the other pixels. Thus, the luminance of respective pixels of the pixel row including such pixels is increased, and this phenomenon appears as lateral stripes.

The present invention has been made in view of such circumstances, and it is an object of the present invention to provide a display device which can prevent degradation of the display quality even when the inputted video data changes.

A summary of representative aspects of the invention disclosed in this specification is as follows.

EXAMPLE 1

A display device according to the present invention comprises, for example, a pixel array in which a plurality of pixel rows, each of which includes a plurality of pixels arranged in parallel along a first direction, are arranged in parallel along a second direction which intersects the first direction; a scanning driver circuit which sequentially selects the plurality of pixel rows in response to a scanning signal; a data driver circuit which supplies a display signal to the respective pixels included in at least one row selected in response to a scanning signal; and a display control circuit which controls a display operation of the pixel array.

In this display device, lines of image data are inputted to the data driver circuit one after another for every horizontal scanning period of the video data, and the data driver circuit alternately repeats (i) a first step of generating a display signal corresponding to each one of the lines of the video data sequentially for every fixed period and of outputting the display signal to the pixel array N-times (N being a natural number equal to or greater than 2) and (ii) a second step of generating a display signal which makes the luminance of the pixels lower than the luminance of the pixel in the first step for the fixed period and of outputting the display signal to the pixel array M-times (M being a natural number smaller than N).

The scanning driver circuit alternately repeats (i) a first selection step of selecting the plurality of pixel rows for every Y rows (Y being a natural number smaller than the N/M) sequentially from one end to another end of the pixel array along the second direction in the first step and (ii) a second selection step of selecting the plurality of pixel rows other than the pixel rows (Y×N) selected in the first selection step for every Z rows (Z being a natural number not smaller than N/M) sequentially from one end to another end of the pixel array along the second direction in the second step.

The outputting of N pieces of display signals in the first step and the outputting of M pieces of display signals in the second step are performed in response to periods which are obtained by evenly dividing the N-pieces of the horizontal scanning periods which are sequentially outputted into (N+M) pieces of periods.

EXAMPLE 2

The display device according to the present invention is, for example, on the premise of the constitution of the Example 1, characterized in that the number of rows: Y of the pixel rows which are selected in the first selection step in response to a single outputting of the display signal in the first step is 1; the number of outputs: N of the display signal in the first step is 4 or more; the number of rows: Z of the pixel rows which are selected in the second selection step in response to a signal outputting of the display signal in the second step is 4 or more; and the number of outputs: M of the display signal in the second step is 1.

EXAMPLE 3

A display device according to the present invention comprises, for example, a pixel array in which a plurality of pixel rows, each of which includes a plurality of pixels arranged in parallel along a first direction, are arranged in parallel along a second direction which intersects the first direction; a scanning driver circuit which sequentially selects the plurality of pixel rows in response to a scanning signal; a data driver circuit which supplies a display signal to the respective pixels included in at least one row selected in response to a scanning signal; and a display control circuit which controls a display operation of the pixel array.

In this display device, lines of video data are inputted to the data driver circuit one after another for every horizontal scanning period of the video data, and the data driver circuit alternately repeats (i) a first step of generating a display signal corresponding to each one of the lines of the video data sequentially for every fixed period and of outputting the display signal to the pixel array N-times (N being a natural number equal to or greater than 2) and (ii) a second step of generating a display signal which makes the luminance of the pixels lower than the luminance of the pixel in the first step for the fixed period and of outputting the display signal to the pixel array M-times (M being a natural number smaller than N).

The scanning driver circuit alternately repeats (i) a first selection step of selecting the plurality of pixel rows for every Y rows (Y being a natural number smaller than the N/M) sequentially from one end to another end of the pixel array along the second direction in the first step and (ii) a second selection step of selecting the plurality of pixel rows other than the pixel rows (Y×N) selected in the first selection step for every Z rows (Z being a natural number not smaller than N/M) sequentially from one end to another end of the pixel array along the second direction in the second step.

The display device includes a circuit in which the outputting of N pieces of display signals in the first step and the outputting of M pieces of display signals in the second step are performed in response to periods which are obtained by evenly dividing the N-pieces of the horizontal scanning periods which are sequentially outputted into (N+M) pieces of periods.

EXAMPLE 4

The display device according to the present invention is, for example, on the premise of the constitution of the Example 3, characterized in that the number of rows: Y of the pixel rows which are selected in the first selection step in response to single outputting of the display signal in the first step is 1; the number of outputs: N of the display signal in the first step is 4 or more; the number of rows: Z of the pixel rows which are selected in the second selection step in response to single outputting of the display signal in the second step is 4 or more; and the number of outputs: M of the display signal in the second step is 1.

EXAMPLE 5

The display device according to the present invention is, for example, on the premise of the constitution of the Example 3, characterized in that there is a circuit which generates a horizontal synchronizing signal which is corrected by a horizontal counter which allows inputting of a horizontal synchronizing signal and a clock signal contained in an external video signal source therein, a decode value calculation circuit which allows inputting of the horizontal synchronizing signal and a count value from the horizontal counter and a decoding circuit to which each decode value from the decode calculation circuit and the counter value from the horizontal counter are inputted.

EXAMPLE 6

The display device according to the present invention is, for example, on the premise of the constitution of any one of the Examples 3 and 5, characterized in that the circuit is incorporated into the display control circuit.

The present invention is not limited to the above-mentioned constitution and various modifications are conceivable without departing from the technical concept of the present invention.

DESCRIPTION OF THE PREFERRED EMBODIMENTS

Preferred embodiments of a liquid crystal display device according to the present invention will be explained in conjunction with the drawings.

First Embodiment

A display device and a method of driving the same according to a first embodiment of the present invention will be explained in conjunction with FIG. 1 to FIG. 7. In this embodiment, the explanation is based on a display device (liquid crystal display device) which uses an active matrix-type liquid crystal display panel as a pixel array. However, the basic structure and driving method of the display device are applicable also to a display device which uses an electroluminescence array or a light emitting diode array as a pixel array.

Figure 1:
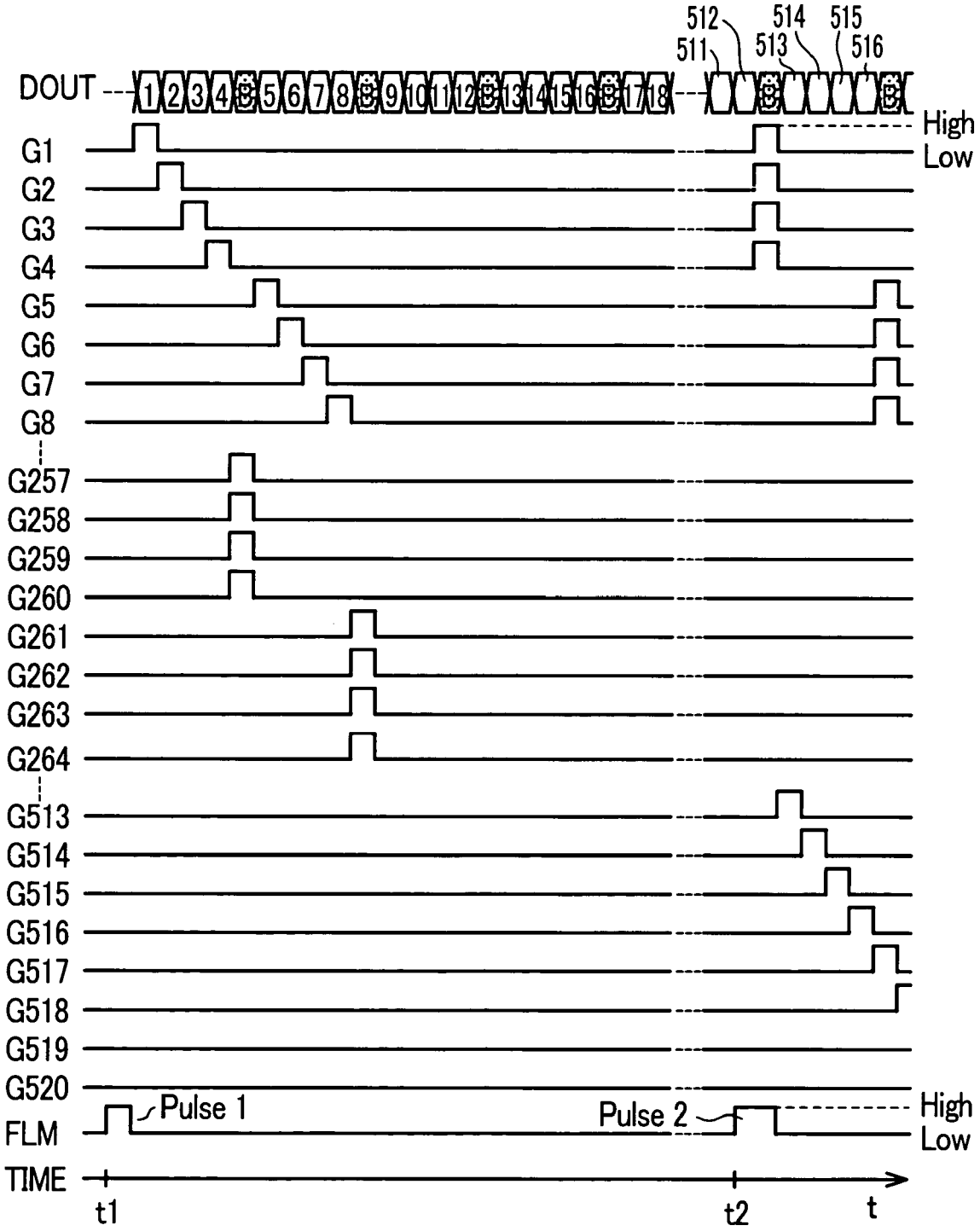
FIG. 1 is a timing chart which shows the output timing of display signals and driving waveforms of scanning lines which correspond to the output timing in a first embodiment of a method of driving a liquid crystal display device according to the present invention.
Figure 2:
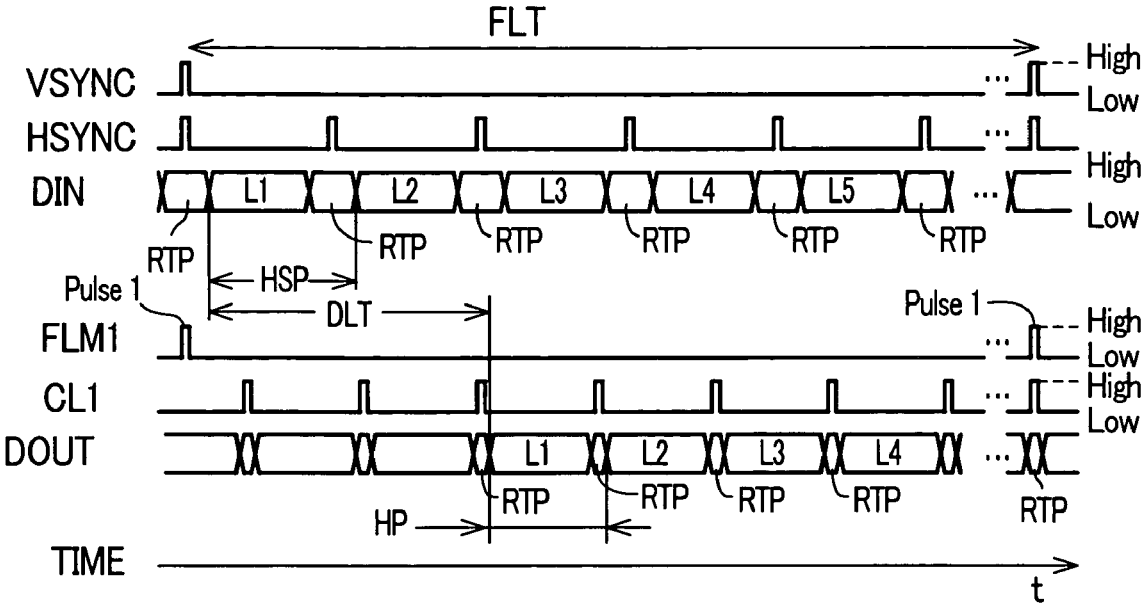
FIG. 2 is a timing chart showing the timing of input waveforms (input data) of video data to a display control circuit (timing controller) and output waveforms (driver data) from the display control circuit in the first embodiment of a method of driving a liquid crystal display device according to the present invention.
Figure 3:
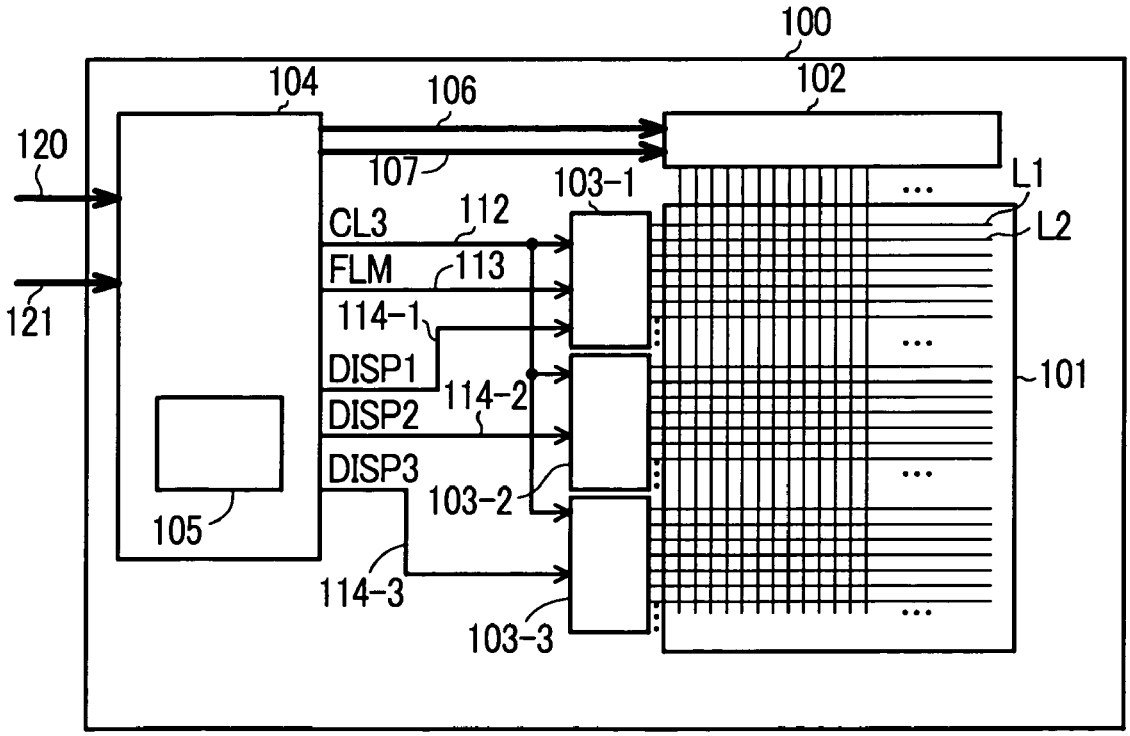
FIG. 3 is a block diagram showing the general outline of the liquid crystal display device according to the present invention.
Figure 9:
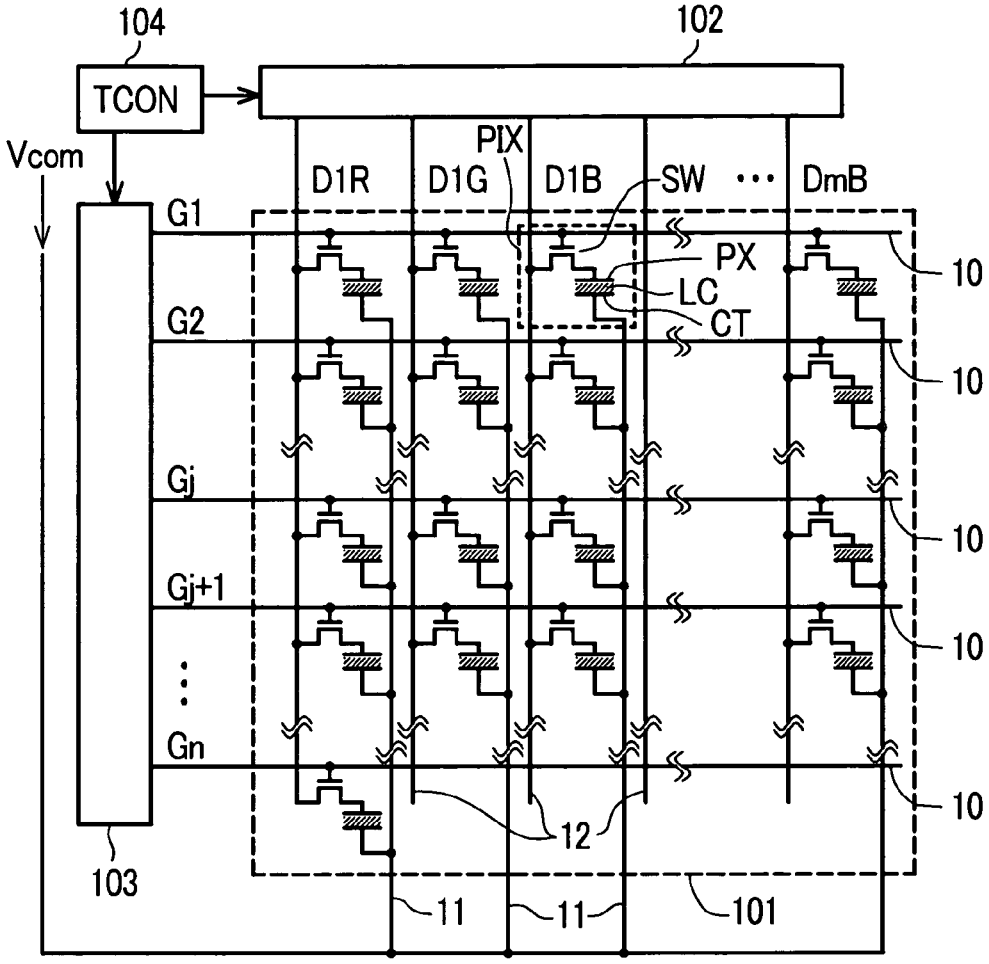
FIG. 9 is a schematic diagram of one example of a pixel array provided to an active matrix type display device.

FIG. 1 is a timing chart showing the selection timing of display signal outputs (data driver output voltages) DOUT to the pixel array of the display device according to the present invention and scanning signal lines G1 in the inside of the pixel array corresponding to the respective signal outputs. FIG. 2 is a timing chart showing timing of inputting (input data) DIN of image data to a display control circuit (timing controller) provided to the display device and timing of outputting of image data (driver data) from the display control circuit. FIG. 3 is a block diagram showing a general outline of the display device of the embodiment of the present invention, wherein one example of the details of the pixel array 101 shown in FIG. 3 and a periphery thereof is shown in FIG. 9. The previously-mentioned timing charts shown in FIG. 1 and FIG. 2 are based on the constitution of the display device (liquid crystal display device) shown in FIG. 3.

Figure 4:
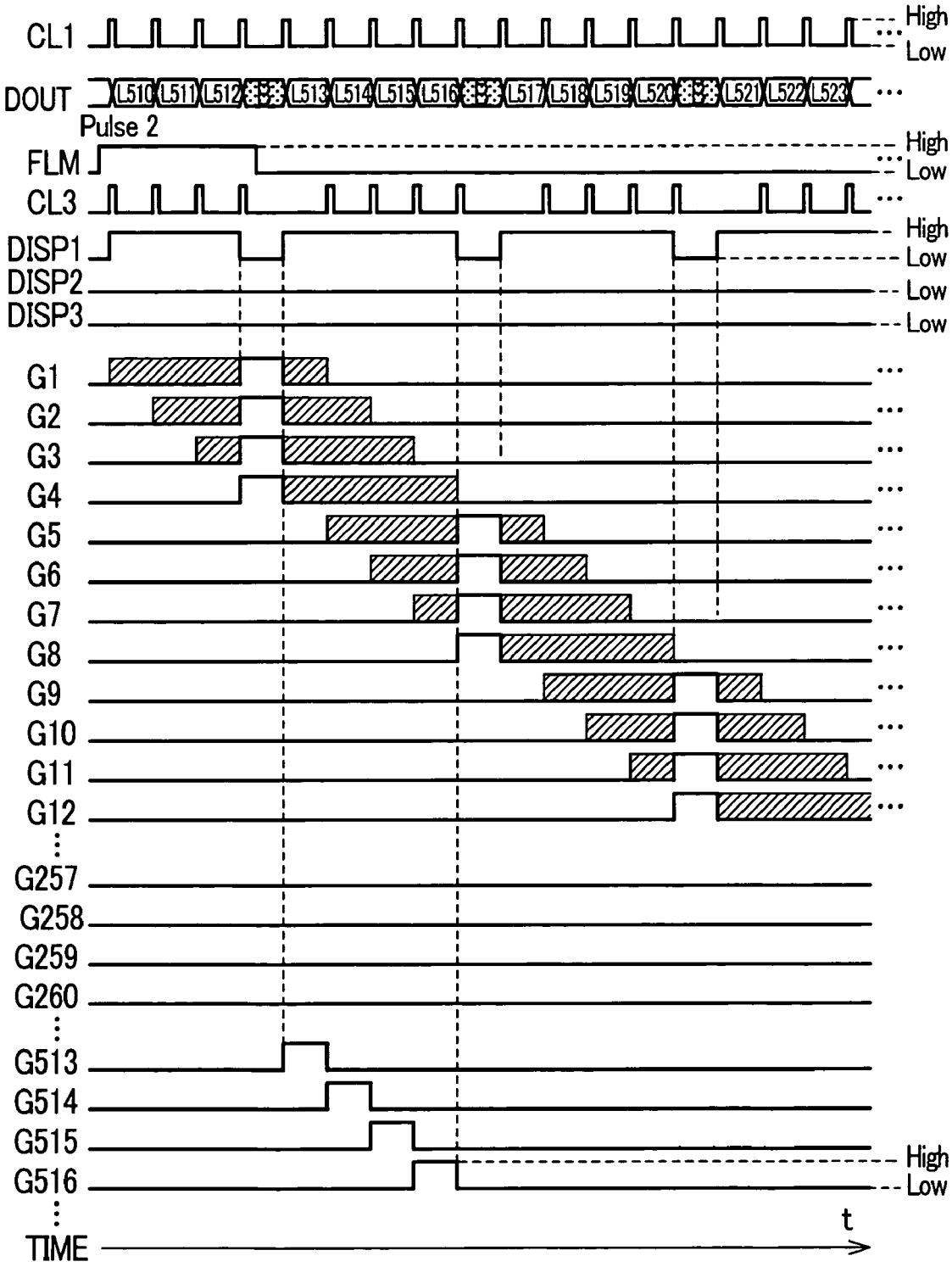
FIG. 4 is a timing chart showing driving waveforms in which four scanning lines are selected simultaneously during an output period of display signals in the first embodiment of a method of driving a liquid crystal display device according to the present invention.

FIG. 4 is a timing chart showing another example of the timing for each selection of display signal outputs (data driver output voltages) to the pixel array of the display device according to this embodiment and scanning signal lines corresponding to the respective outputs. Out of scanning signal lines to which scanning signals are outputted from a shift-register type scanning driver during an outputting period of the display signals, four scanning signal lines are selected and display signals are supplied to pixel rows which respectively correspond to these scanning signal lines.

Figure 5:
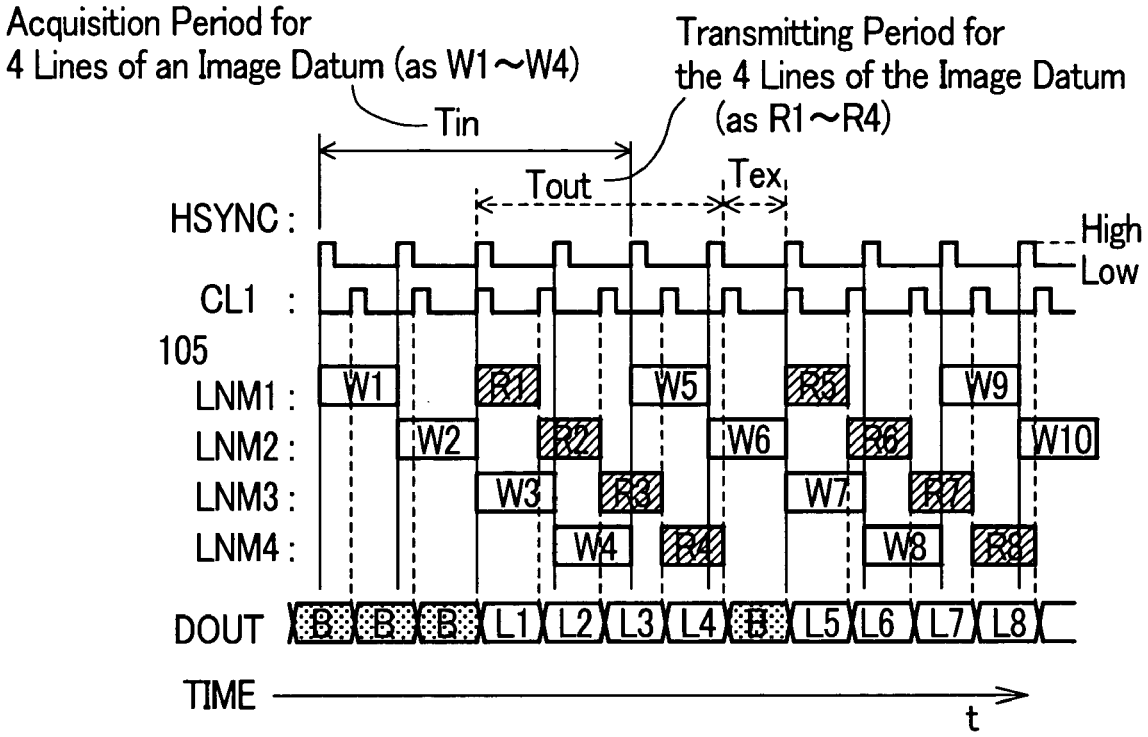
FIG. 5 is a timing chart showing respective timings for writing video data to a plurality of (for example, four) line memories provided to a liquid crystal display device according to the present invention and for reading out of the video data from the line memories.

FIG. 5 is a timing chart showing the timing in which image data for 4 lines are written one after another to every other of 4 line memories included in a line-memory circuit 105 provided to a display control circuit 104 (see FIG. 3) and the image data are read out from respective line memories and transferred to a data driver (video signal driver circuit).

Figure 6:
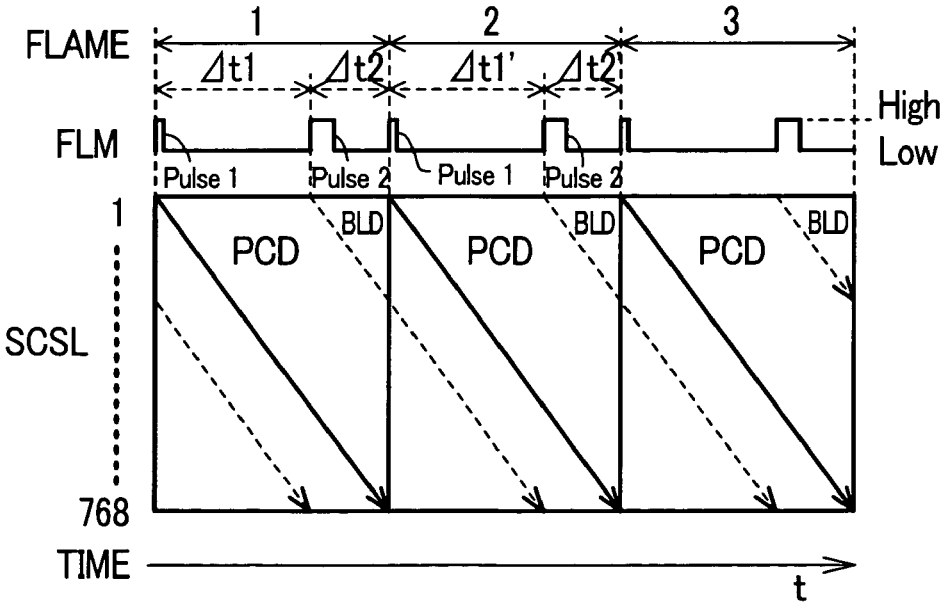
FIG. 6 is a timing chart showing the pixel display timing of every frame period (each one of three continuous frame periods) in the first embodiment of the method of driving the liquid crystal display device according to the present invention.
Figure 7:
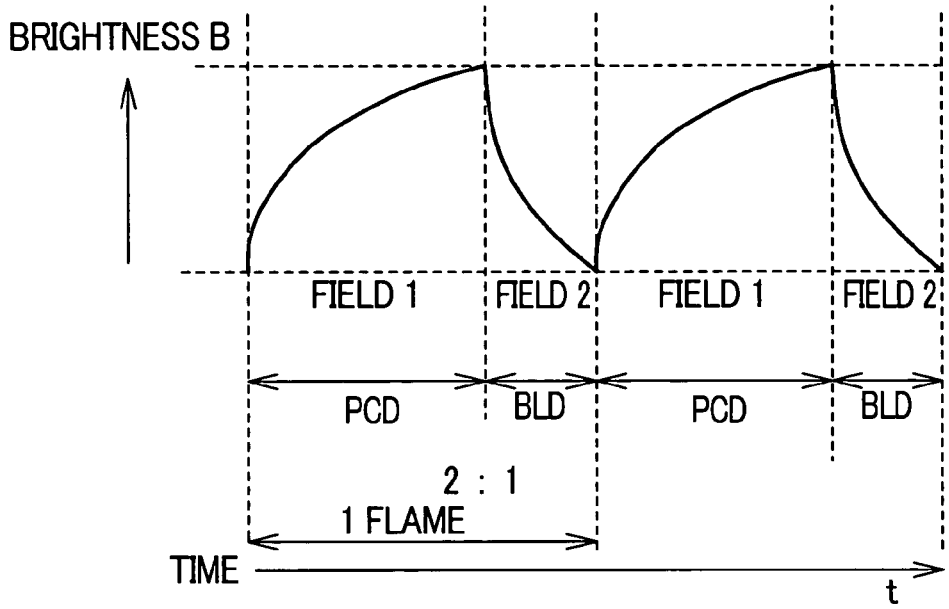
FIG. 7 is a characteristic diagram showing the luminance response to display signals (change of optical transmissivity of a liquid crystal layer corresponding to the pixels) when the liquid crystal display device of the present invention is driven in accordance with pixel display timing shown in FIG. 6.

FIG. 6 relates to a method of driving the display device of the present invention and shows the display timing of image data and blanking data according to this embodiment in the pixel array; while, FIG. 7 shows the luminance response (change of optical transmissivity of liquid crystal layer corresponding to pixels) of pixels when the display device (liquid crystal display device) of this embodiment is driven in accordance with this timing.

Firstly, a general description of the display device 100 of this embodiment will be explained in conjunction with FIG. 3.

The display device 100 includes a liquid crystal display panel (hereinafter referred to as a "liquid crystal panel") having a resolution of the WXGA class illustrated as a pixel array 101. The pixel array 101 having a resolution of the WXGA class is not limited to a liquid crystal panel, and it is characterized in that there are 768 pixel rows, each of which has pixels of 1280 dots in the horizontal direction, which rows are juxtaposed in the vertical direction in the screen.

The construction of the pixel array 101 of the display device of this embodiment is substantially the same as that of the pixel array of the display device shown in FIG. 9; however, due to the resolution thereof, the gate lines 10 actually consist of 768 lines and the data lines 12 actually consist of 1280 lines respectively juxtaposed within the screen area of the pixel array 101. Further, in the pixel array 101, 983040 pixels PIX, each of which is selected in response to a scanning signal transmitted through one of the gate lines and receives a display signal from one of the data lines, are arranged two-dimensionally, and images are produced by these pixels PIX.

When the pixel array displays color images, each pixel is divided in the horizontal direction corresponding to the number of primary colors used in the color display. For example, in a liquid crystal panel having a color filter corresponding to the three primary colors (red, green, blue) of light, the number of the above-mentioned data lines 12 is increased to 3840 lines and the total number of pixels PIX included in the display screen is also three times as large as the above-mentioned value.

To describe the construction of the above-mentioned liquid crystal panel which serves as the pixel array 101 in this embodiment in more detail, each pixel PIX included in the liquid crystal panel is provided with a thin film transistor (abbreviated as TFT) which operates as a switching element SW. Further, each pixel is operated in a so-called normally black-displaying mode in which, the larger the display signal supplied to each pixel, the higher will be the luminance exhibited by the pixel. In addition, a pixel of the above-mentioned electroluminescence array or light emitting diode array is also operated in the normally black-displaying mode.

In the liquid crystal panel operated in the normally black-displaying mode, as the potential difference is increased between a gray scale voltage, that is applied to the pixel electrode PX formed in the pixel PIX in FIG. 9 from the data line 12 through the switching element SW, and a counter voltage (also referred to as reference voltage, common voltage), that is applied to the counter electrode CT which faces the pixel electrode PX with a liquid crystal layer LC sandwiched therebetween, the greater the optical transmissivity of the liquid crystal layer LC is elevated so as to increase the luminance of the pixel PIX. That is, with respect to the gray scale voltage, which is the display signal of the liquid crystal panel, the remoter the value of the gray scale voltage is from the value of the counter voltage, the more the display signal is increased.

To the pixel array (TFT-type liquid crystal panel) 101 shown in FIG. 3, in the same manner as the pixel array 101 shown in FIG. 9, a data driver (display signal driver circuit)

102, which supplies display signals (gray scale voltages or tone voltages) corresponding to the display data to the data lines (signal lines) 12 formed on the pixel array 101, and scanning drivers (scanning signal driver circuits) 103-1, 103-2, 103-3, which supply scanning signals (voltage signals) to the gate lines (scanning lines) 10 formed on the pixel array 101, are respectively provided. In this embodiment, although the scanning driver is divided into three drivers along the so-called vertical direction of the pixel array 101, the number of these drivers is not limited to 3. Further, these drivers may be replaced with one scanning driver which performs these functions. On the other hand, the data driver may be divided into several components.

A display control circuit (timing controller) 104 transmits the above-mentioned display data (driver data) 106 and timing signals (data driver control signals) 107 for controlling display signal outputs corresponding to the display data 106 to the data driver 102. Further, the display control circuit 104 transmits scanning clock signals 112 and scanning start signals 113 to the respective scanning drivers 103-1, 103-2, 103-3. Although the display control circuit 104 also transfers scanning state selecting signals 114-1, 114-2, 114-3 corresponding to the scanning drivers 103-1, 103-2, 103-3 to these scanning drivers 103-1, 103-2, 103-3, this function will be explained later in more detail. The scanning state selecting signals are also referred to as display-operation selecting signals in view of the function thereof.

The display control circuit 104 receives image data (video signals) 120 and video control signals 121 that are inputted to the display control circuit 104 from an external video signal source of the display device 100, such as a television receiver set, a personal computer, a DVD player or the like. Although a memory circuit 105, which temporarily stores the image data 120 is provided in the inside of or at the periphery of the display control circuit 104, in this embodiment, a line memory circuit 105 is incorporated in the display control circuit 104. The video control signals 121 include a vertical synchronizing signal VSYNC which controls the transmission state of the image data, a horizontal synchronizing signal HSYNC, a dot clock signal DOTCLK and a display timing signal DTMG. The image data which generates an image for one screen in the display device 100 is inputted to the display control circuit 104 in response to (in synchronism with) the vertical synchronizing signal VSYNC. That is, the image data are sequentially inputted to the display device 100 (display control circuit 104) from the above-mentioned video signal source for every cycle (also referred to as vertical scanning period or frame period) defined by the vertical synchronizing signal VSYNC, and the image for one screen is displayed on the pixel array 101 successively during every frame period. The image data in one frame period is sequentially inputted to the display device by dividing a plurality of line data included in the image data with a cycle (also referred to as a horizontal scanning period) defined by the above-mentioned horizontal synchronizing signals HSYNC. That is, each image data which is inputted to the display device for every frame period includes a plurality of line data, and the image of one screen generated by this line data is generated by sequentially arranging images in the horizontal direction depending on every line data for every horizontal scanning period in the vertical direction. Data corresponding to respective pixels arranged in the horizontal direction in one screen are identified with cycles in which the above-mentioned respective line data are defined by the above-mentioned dot clock signals.

Since the image data 120 and video control signals 121 are also inputted to a display device which uses a cathode ray tube, it is necessary to ensure sufficient time for sweeping the electron lines thereof from the scanning completion position to the scanning start position for every horizontal scanning period and every frame period. This time constitutes a dead time in the transfer of the image information; and, hence, regions which are referred to as retrace periods RTP, which do not contribute to the transfer of image information corresponding to the dead time, are also provided to the image data 120. In the image data 120, the regions which correspond to these retrace periods are discriminated from other regions which contribute to the transfer of image information due to the above-mentioned display timing signal DTMG.

On the other hand, the active matrix type display device 100 of this embodiment generates display signals corresponding to an amount of image data for one line (the above-mentioned line data) at the data driver 102 and these display signals are collectively outputted to a plurality of data lines (signal lines) 12, which are arranged in parallel in the pixel array 101 in response to the selection of the gate lines 10 by the scanning driver 103. Accordingly, theoretically, inputting of the line data to the pixel rows is continued from one horizontal scanning period to the next horizontal scanning period without sandwiching the retrace period therebetween, while inputting of the image data to the pixel array is also continued from one frame period to next frame period. Accordingly, in the display device 100 of this embodiment, reading out of every image data (line data) for one line from the memory circuit (line memory) 105 using the display control circuit 104 is performed in accordance with a cycle that is generated by shortening the retrace periods, which are included in the above-mentioned horizontal scanning periods HSP (allocated to storing of the image data for 1 line to the memory circuit 105). Since this cycle is reflected on an output interval of the display signals to the pixel array 101 to be described later, the cycle is referred to as the horizontal period of the pixel array operation, or simply as the horizontal period HP. The display control circuit 104 generates a horizontal clock CL1, which defines the horizontal period, and transfers the horizontal clock CL1 as one of the above-mentioned data driver control signals 107 to the data driver 102. In this embodiment, with respect to the time for storing the image data for one line to the memory circuit 105 (the above-mentioned horizontal scanning period), by shortening the time for reading out the image data from the memory circuit 105 (the above-mentioned horizontal period), the time for inputting blanking signals to the pixel array 101 for every one frame period is produced.

FIG. 2 is a timing chart showing one example of the inputting (storing) of image data to the memory circuit 105 and the outputting (reading-out) of the image data from the memory circuit 105 using the display control circuit 104. The image data which is inputted to the display device for every frame period defined by the pulse interval of the vertical synchronizing signal VSYNC is, as shown in the waveforms of the input data DIN, sequentially inputted to the memory circuit 105 using the display control circuit 104 in response to (in synchronism with) the horizontal synchronizing signal HSYNC, including respective retrace periods for every plurality of line data (image data of one line) L1, L2, L3, . . . included in the image data. The display control circuit 104 sequentially reads out the line data L1, L2, L3, . . . stored in the memory circuit 105 in accordance with the above-mentioned horizontal clock CL1, or the timing signals similar to the horizontal clock CL1, as shown in the waveforms of the output data. Here, the retrace periods TR which cause respective line data L1, L2, L3, . . . outputted from the memory circuit 105 to be spaced apart from each other along a time axis TIME are made shorter than the retrace periods TR which cause respective line data L1, L2, L3 . . . inputted to the memory circuit 105 to be spaced apart from each other along the time axis TIME. Accordingly, between the period necessary for inputting the line data to the memory circuit 105 N times (N being a natural number of 2 or more) and the period necessary for outputting these line data from the memory circuit 105 (N-time line data outputting period), a time which is sufficient for outputting the line data M times (M being a natural number smaller than N) from the memory circuit 105 is produced. In this embodiment, by making use of a so-called extra time in which the image data for M lines is outputted from the memory circuit 105, the pixel array 101 is made to perform a separate display operation.

Here, the image data (line data included in the image data in FIG. 2) is temporarily stored in the memory circuit 105 before being transferred to the data driver 102, and, hence, the image data is read out by the display control circuit 104 during a delay time DLT corresponding to the stored period. When a frame memory is used as the memory circuit 105, this delay time corresponds to one frame period. When the image data is inputted to the display device at the frequency of 30 Hz, one frame period thereof is about 33 ms (milliseconds), and, hence, a user of the display device cannot perceive the delay of the display time of the image with respect to an input time of the image data to the display device. However, by providing a plurality of line memories to the display device 100 in place of the frame memory as the above-mentioned memory circuit 105, this delay time can be shortened, the structure of the display control circuit 104 or the peripheral circuit structure can be simplified or an increase in the size can be suppressed.

One example of the method of driving the display device 100 using the line memory for storing a plurality of line data as the memory circuit 105, will be explained in conjunction with FIG. 5. In the driving of the display device 100 according to this example, in the above-mentioned extra time between the period for inputting image data for N lines to the display control circuit 104 and the period for outputting image data for N lines from the display control circuit 104 (period for sequentially outputting the display signals respectively corresponding to the N-line image data from the data driver 102), display signals (hereinafter, these signals being referred to as blanking signals) which mask the display signals which are already held in the pixel array (the image data which are inputted to the pixel array in one preceding frame period) are written M times. In this driving method of the display device 100, the first step in which the display signals are sequentially generated from respective N-line image data using the data driver 102 and the display signals are outputted to the pixel array 101 sequentially (N times in total) in response to the horizontal clocks CL1 and the second step in which the above-mentioned blanking signals are outputted to the pixel array 101 in response to the horizontal clock CL1 M times are repeated. Although a further explanation of this method of driving the display device will be explained later in conjunction with FIG. 1, the above-mentioned N value is set to 4 and the above-mentioned M value is set to 1 in FIG. 5.

As shown in FIG. 5, the memory circuit 105 includes four line memories LNM 1 to 4 which perform writing and reading-out of data independently from each other, wherein the image data 120 for every one line, which is sequentially inputted to the display device 100 in synchronism with the horizontal synchronizing signal HSYNC, are sequentially stored into one of these line memories 1 to 4 one after another. That is, the memory circuit 105 has a memory capacity for 4 lines. For example, in an acquisition period Tin of image data 120 for 4 lines by the memory circuit 105, the image data W1, W2, W3, W4 for 4 lines are inputted to the line memory 4 from the line memory 1 sequentially.

The acquisition period Tin of image data extends over time which is substantially four times as long as the horizontal scanning period defined by the pulse interval of the horizontal synchronizing signal HSYNC included in the vide control signals 121. However, before this acquisition period Tin of image data is finished with storing of the image data into the line memory 4, the image data which are stored in the line memory 1, the line memory 2 and the line memory 3 in this period are sequentially read out as the image data R1, R2, R3 using the display control circuit 104. Accordingly, as soon as the acquisition period Tin of image data W1, W2, W3, W4 for 4 lines is finished, it is possible to start storing of image data W5, W6, W7, W8 for the next 4 lines to the line memories 1 to 4.

In the above-mentioned explanation, the reference symbol affixed to every one line of the image data is changed between the time of inputting the image data to the line memory and the time of outputting the image data from the line memory. For example, W1 is affixed to the former and R1 is affixed to the latter. This reflects the fact that the image data for every one line includes the above-mentioned retrace period; and, when the image data are read out from any one of line memories 1 to 4 in response to (in synchronism with) the horizontal clock CL1 having higher frequency than the above-mentioned horizontal synchronizing signal HSYNC, the retrace periods included in the image data are shortened. Accordingly, for example, compared to the length of the image data for one line (referred to as line data hereinafter) W1 inputted to the line memory 1 along a time axis, the length of the line data R1 outputted from the line memory 1 along the time axis is shorter, as shown in FIG. 5.

In the period from the inputting of the line data to the line memory to the outputting of the line data from the line memory, even when image information (for example, generating image of one line along the horizontal direction of the screen) included in the line data is not processed, the length of the image information along the time axis can be compressed as described above. Accordingly, between the finish time of outputting of the 4-line image data R1, R2, R3, R4 from the line memories 1 to 4 and the start time of outputting of the 4-line image data R5, R6, R7, R8 from the line memories 1 to 4, the above-mentioned extra time Tex is generated.

The 4-line image data R1, R2, R3, R4 which are read out from the line memories 1 to 4 are transferred to the data driver 102 as the driver data 106 and display signals L1, L2, L3, L4 which respectively correspond to the image data R1, R2, R3, R4 are produced (display signals L5, L6, L7, L8 being also produced correspond to the image data R5, R6, R7, R8 for 4 lines which are read out next time). These display signals are respectively outputted to the pixel array 101 in response to the above-mentioned horizontal clock CL1 in the order indicated by an eye diagram of outputting display signals, as shown in FIG. 5. Accordingly, by allowing the memory circuit 105 to include at least a line memory (or a mass thereof) having capacity of the above-mentioned N lines, it is possible to input image data of one line inputted to the display device during a certain frame period to the pixel array during this frame period, and, hence, the response speed of the display device in response to inputting of image data can be enhanced.

On the other hand, as can be clearly understood from FIG. 5, the above-mentioned extra time Tex corresponds to the time for outputting the image data of one line from the line memory in response to the above-mentioned horizontal clock CL1. In this embodiment, another or separate display signal is outputted to the pixel array a single time by making use of this extra time Tex. Another display signal according to this embodiment is a so-called blanking signal B which decreases the luminance of the pixel to which another display signal is inputted to a level equal to or below the luminance before another display signal is inputted to the pixel. For example, the luminance of the pixel which is displayed with a relatively high gray scale (white or bright gray color close to white in a monochromatic image display) before one frame period is decreased to a level lower than the above-mentioned level in response to the blanking signal B. On the other hand, the luminance of the pixel which is displayed with a relatively low gray scale (black or dark gray color like charcoal gray close to black in a monochromatic image display) before one frame period is hardly changed even after inputting of the blanking signal B. This blanking signal B temporarily converts the image generated in the pixel array for every frame period into a dark image (blanking image). Due to such a display operation of the pixel array, even with respect to a hold-type display device, the image display in response to the image data inputted to the display device for every frame period can be performed in the same manner as the image display of an impulse type display device.

By applying the above-mentioned method of driving the display device which repeats the first step in which N-line image data are sequentially outputted to the pixel array and the second step in which the blanking signal B is outputted to the pixel array M times to the hold-type display device, the image display due to the hold-type display device can be performed in the same manner as the image display due to the impulse-type display device. This driving method of the display device is applicable not only to the display device which has been explained in conjunction with FIG. 5 and includes a line memory having a capacity of at least N lines as the memory circuit 105, but also, for example, it is applicable to a display device which replaces the memory circuit 105 with a frame memory.

The driving method for driving the display device will be further explained in conjunction with FIG. 1. Although the operation of the display device in the above-mentioned first and second steps defines outputting of the display signals using the data driver 102 in the display device 100 shown in FIG. 3, outputting of the scanning signals (selection of pixel rows) using the scanning driver 103 which is performed corresponding to outputting of the display signals will be described in the following. In the explanation set forth hereinafter, the term "scanning signal", which is applied to the gate line (scanning signal line) 10 and selects the pixel row (a plurality of pixels PIX arranged along the gate line) corresponding to the gate line 10, indicates pulses (gate pulses) of the scanning signals which make the scanning signals respectively applied to the gate lines G1, G2, G3, . . . shown in FIG. 1 assume a High state. In the pixel array shown in FIG. 9, the switching element SW which is provided to the pixel PIX receives the gate pulse through the gate line 10 connected to the switching element SW and allows the display signal supplied from the data line 12 to be inputted to the pixel PIX.

During the period corresponding to the above-mentioned first step, for every outputting of the display signal corresponding to the N-line image data, the scanning signal which selects the pixel row corresponding to the Y line of the gate line is applied to the Y line of the gate line. Accordingly, the scanning signal is outputted N times from the scanning driver 103. Such an application of the scanning signal is sequentially performed in the direction from one end (for example, an upper end in FIG. 3) to another end of the pixel array 101 (for example, a lower end in FIG. 3) for every other of the Y lines of gate lines for the above-mentioned every outputting of the display signal. Accordingly, in the first step, the pixel rows corresponding to gate lines of (Y×N) lines are selected and the display signals generated based on the image data are supplied to respective pixel rows. FIG. 1 shows the output timing (see the eye diagram of data driver output voltage) of the display signals when the value of N is set to 4 and the value of Y is set to 1 and waveforms of the scanning signals which are applied to respective gate lines (scanning lines) corresponding to the output timing. Here, the period of the first step corresponds to the data driver output voltages 1 to 4, 5 to 8, 9 to 12, . . . , 513 to 516, . . . respectively.

For the data drive output voltages 1 to 4, the scanning signal is sequentially applied to the gate lines G1 to G4. For the next data drive output voltages 5 to 8, the scanning signal is sequentially applied to the gate lines G5 to G8. After a lapse of further time, for the data drive output voltages 513 to 516, the scanning signal is sequentially applied to the gate lines G513 to G516. That is, outputting of scanning signals from the scanning driver 103 is sequentially performed in the direction that the address number (G1, G2, G3, . . . , G257, G258, G259, . . . , G513, G514, G515, . . . ) of the gate line 10 in the pixel array 101 is increased.

On the other hand, during the period corresponding to the above-mentioned second step, for every M-times of outputting the display signal, the scanning signal which selects the pixel rows corresponding to the Z-line of the gate lines is applied to the line Z of the gate lines as the blanking signal. Accordingly, the scanning signal is outputted M times from the scanning driver 103. The combination of gate lines (scanning lines) to which the scanning signal is applied for outputting of the scanning signal from the scanning driver 103 a single time is not particularly limited. However, from the viewpoint of holding the display signal supplied to the pixel row in the first step and reducing a load applied to the data driver 102, it is preferable to sequentially apply the scanning signal to every other of the Z lines of the gate lines for every outputting of the display signal. The application of the scanning signal to the gate lines in the second step is sequentially performed from one end of the pixel array 101 to another end of the pixel array 101 in the same manner as the first step. Accordingly, in the second step, the pixel rows corresponding to the gate lines consisting of (Z×M) lines are selected and the blanking signal is supplied to respective pixel rows.

FIG. 1 shows the output timing of the blanking signals B in the second step, which follows the first step, when the value of M is set to 1 and the value of Z is set to 4, and the waveforms of the scanning signals which are applied to respective gate lines (scanning lines) corresponding to the output timing. In the second step, which follows the first step, in which the scanning signal is sequentially applied to the gate lines G1 to G4, for outputting the blanking signal B a single time, the scanning signal is sequentially applied to 4 gate lines ranging from G257 to G260. Then, in the second step, which follows the first step, in which the scanning signal is sequentially applied to the gate lines G5 to G8, for outputting of the blanking signal B a single time, the scanning signal is sequentially applied to 4 gate lines ranging from G261 to G264. Further, in the second step, which follows the first step, in which the scanning signal is sequentially applied to the gate lines G513 to G516, for outputting the blanking signal B a single time, the scanning signal is sequentially applied to 4 gate lines ranging from G1 to G4.

As described above, in the first step, the scanning signal is sequentially applied to four gate lines, respectively, while in the second step, to apply the scanning signal to four gate lines collectively or simultaneously, for example, in response to outputting of the display signal from the data driver 102, it is necessary to match the operation of the scanning driver 103 to respective steps. As mentioned previously, the pixel array used in this embodiment has a resolution of the WXGA class and gate lines consisting of 768 lines are juxtaposed to the pixel array. On the other hand, a group of four gate lines (for example, G1 to G4) which are sequentially selected in the first step and a group of four gate lines (for example, G257 to G260) which are sequentially selected in the second step, which follows the first step, are spaced apart from each other by the gate lines consisting of 252 lines along the direction that the address number of the gate lines 10 in the pixel array 101 is increased. Accordingly, the gate lines consisting of 768 lines, which are juxtaposed in the pixel array, are divided into three groups each consisting of 256 lines along the vertical direction thereof (or extending direction of the gate lines), and the outputting operation of scanning signals from the scanning driver 103 is independently controlled for every group. To enable such a control, in the display device shown in FIG. 3, three scanning drivers 103-1, 103-2, 103-3 are arranged along the pixel array 101 and the outputting operation of scanning signals from respective scanning drivers 103-1, 103-2, 103-3 are controlled in response to the scanning state selection signals 114-1, 114-2, 114-3.

For example, when the gate lines G1 to G4 are selected in the first step and the gate lines G257 to G260 are selected in the second step, which follows the first step, the scanning state selection signal 114-1 instructs the scanning driver 103-1 to assume a scanning state in which outputting of the scanning signal for sequentially selecting the gate line for continuous 4 pulses of the scanning clock CL3 one after another and stopping of outputting of the scanning signals for one pulse of the scanning clock CL3, which follows the outputting of the scanning signal, are repeated. On the other hand, the scanning state selection signal 114-2 instructs the scanning driver 103-2 to assume a scanning state in which stopping of the outputting of scanning signals for 4 continuous pulses of the scanning clock CL3 and outputting of scanning signals to 4 line gate lines for one pulse of the scanning clock CL3 which follows the stopping of outputting are repeated. Further, the scanning state selection signal 114-3 makes the scanning clock CL3 inputted to the scanning driver 103-3 ineffective and stops the outputting of the scanning signal initiated by the scanning clock CL3. The respective scanning drivers 103-1, 103-2, 103-3 are provided with two control signal transfer networks corresponding to the above-mentioned two instructions by the scanning state selection signals 114-1, 114-2, 114-3.

On the other hand, the waveform of the scanning start signal FLM shown in FIG. 1 includes two pulses which rise at points of time t1 and t2. A series of gate line selection operations in the above-mentioned first step are started in response to the pulse (described as pulse 1, hereinafter referred to as the first pulse) of the scanning start signal FLM, which is generated at the point of time t1, while a series of gate line selection operations in the above-mentioned second step are started in response to the pulse of the scanning start signal FLM (described as pulse 2, hereinafter referred to as the second pulse) which is generated at the point of time t2. The first pulse of the scanning start signal FLM also responds to the start of inputting of image data (defined by a pulse of the above-mentioned vertical synchronizing signal VSYNC) to the display device during one frame period. Accordingly, the first pulse and the second pulse of the scanning start signals FLM are repeatedly generated every frame period.

Further, by adjusting the interval between the first pulse of the scanning start signal FLM and the second pulse, which follows the first pulse, of the scanning start signal FLM and an interval between this second pulse and the pulse which follows the second pulse (for example, the first pulse of the next frame period), the time for holding the display signal based on image data in the pixel array during 1 frame period can be adjusted. That is, the pulse interval including the first pulse and the second pulse generated on the scanning start signal FLM can take two different values (time widths) alternately. On the other hand, the scanning start signal FLM is generated by the display control circuit (timing controller) 104. From the above, the above-mentioned scanning state selection signals 114-1, 114-2, 114-3 can be generated in reference to the scanning start signal FLM in the display control circuit 104.

FIG. 1 shows the operation in which, every time the image data shown in FIG. 1 has been written 4 times in the pixel array for every one line, the blanking signal is written in the pixel array a single time. As has been explained in conjunction with FIG. 5, such a blanking signal writing operation is completed within the time necessary for inputting the image data for 4 lines to the display device. Further, in response to the above-mentioned operation, the scanning signal is outputted to the pixel array 5 times. Accordingly, the horizontal period necessary for operating the pixel array becomes 4/5 of the horizontal scanning period of the video control signal 121. In this manner, inputting of the image data (display signals based on the image data) and the blanking signal to be inputted to the display device during one frame period to all of the pixels within the pixel array is completed within this one frame period.

The blanking signal shown in FIG. 1 generates pseudo image data (hereinafter referred to as blanking data) in the display control circuit 104 and the peripheral circuit thereof. Here, the pseudo image data may be transferred to the data driver 102 and the blanking data may be generated in the data driver 102. Alternatively, a circuit which generates the blanking signal may be preliminarily formed in the data driver 102 and the blanking signal may be outputted to the pixel array 101 in response to a specific pulse of the horizontal clock CL1 transferred from the display control circuit 104.

In the former case, a frame memory is provided in the display control circuit 104 or in the vicinity of the display control circuit 104 and the pixel in which the blanking signal is to be strengthened based on the image data for every frame period (pixel displayed with high luminance due to the image data) stored in the frame memory is specified using the display control circuit 104, and the blanking data which causes the data driver 102 to generate a blanking signal which differs in darkness in response to the pixel may be generated.

In the latter case, the number of pulses of the horizontal clock CL1 is counted by the data driver 102 so as to make the data driver 102 output a display signal which enables the pixel to display black or a dark color close to black (for example, color such as charcoal gray) in response to the count number. At a portion of the liquid crystal display device, a plurality of gray scale voltages which determine the luminance of the pixels are generated by the display control circuit (timing converter) 104. In such a liquid crystal display device, a plurality of gray scale voltages are transferred by the data driver 102, the gray scale voltages corresponding to the image data are selected and are outputted to the pixel array by the data driver 102. In the same manner, the blanking signals may be generated by selection of the gray scale voltages in response to pulses of the horizontal clock CL1 due to the data driver 102.

The manner of outputting display signals to the pixel array and the manner outputting scanning signals to respective gate lines (scanning lines) corresponding to the display signals according to the present invention shown in FIG. 1 are suitable for driving a display device having the scanning driver 103, which has a function of simultaneously outputting a scanning signal to a plurality of gate lines in response to the inputted scanning state selection signal 114. On the other hand, without simultaneously outputting a scanning signal to a plurality of scanning lines, as explained above, by making the respective scanning drivers 103-1, 103-2, 103-3 sequentially output scanning signals for every one line of the gate lines (scanning lines) for every pulse of the scanning clock CL3, the image display operation according to the present invention can be performed. The image display operation of this embodiment, in which inputting of the blanking data into 4 of another pixel rows (the above-mentioned first step in which the blanking data are outputted a single time) is repeated every time the image data of 4 lines are sequentially inputted to one of pixel rows one after another (the above-mentioned first step in which the image data are outputted four times) due to such operations of the scanning drivers 103 will be explained in conjunction with respective output waveforms of the display signals and the scanning signals as shown in FIG. 4.

With respect to a method of driving the display device, which will be explained in conjunction with FIG. 4, the display device shown in FIG. 3 will be referred to in the same manner as in the explanation of FIG. 1. Each scanning driver 103-1, 103-2, 103-3 includes 256 terminals for outputting the scanning signals. That is, each scanning driver 103 can output scanning signals to gate lines consisting of 256 lines at maximum. On the other hand, the pixel array 101 (for example, the liquid crystal display panel) is provided with gate lines 10 consisting of 768 lines and pixel rows which correspond to the respectively gate lines. Accordingly, three scanning drivers 103-1, 103-2, 103-3 are sequentially arranged at one side of the pixel array 101 along the vertical direction (extending direction of the data lines 12 provided to the pixel array). The scanning driver 103-1 outputs the scanning signals to a group of gate lines G1 to G256, the scanning driver 103-2 outputs the scanning signals to a group of gate lines G257 to G512, and the scanning driver 103-3 outputs the scanning signals to a group of gate lines G513 to G768 so as to control the image display on the whole screen (whole region of the pixel array 101) of the display device 100.

The display device to which the driving method explained in conjunction with FIG. 1 is applied and the display device to which the driving method explained hereinafter in conjunction with FIG. 4 is applied are similar with respect to a point that they both have the above-mentioned arrangement of scanning drivers. Further, with respect to the provision that the waveform of the scanning start signal FLM includes the first pulse which starts outputting of a series of scanning signals which are used for inputting the image data to the pixel array and the second pulse which starts outputting of a series of scanning signals which are used for inputting the blanking data to the pixel array in every frame period, the driving method of the display device which has been explained in conjunction with FIG. 1 and the driving method of the display device which will be explained in conjunction with FIG. 4 are similar. Further, also with respect to the provision that the scanning driver 103 acquires the first pulse and the second pulse of the above-mentioned scanning start signal FLM in response to the scanning clock CL 3 and, thereafter, terminals (or a group of terminals) from which the scanning signals are to be outputted in response to the scanning clock CL3 are sequentially shifted in response to the acquisition of the image data or the blanking data into the pixel array, the driving method of the display device using the signal waveforms shown in FIG. 1 and the driving method of the display device using the signal waveforms shown in FIG. 4 are similar.

However, the driving method of the display device of this embodiment, which will be explained in conjunction with FIG. 4, differs from the driving method of the display device which was explained in conjunction with FIG. 1 in the roles of the scanning state selection signals 114-1, 114-2, 114-3. In FIG. 4, respective waveforms of the scanning state selection signals 114-1, 114-2, 114-3 are indicated as DISP1, DISP2, DISP3. The scanning state selection signals 114, first of all, determine the output operations of the scanning signals in the regions which the scanning state selection signals 114 control (a group of pixels corresponding to a group of gate lines G257 to G512 in case of DISP2, for example) in response to operational conditions applied to these regions. In FIG. 4, in the period in which the data driver output voltages exhibit outputs of the display signals L513 to L516 in response to the image data of 4 lines (the above-mentioned first step in which the display signals L513 to L516 are outputted), the scanning signals are applied to the gate lines G513 to G516 from the scanning driver 103-3 corresponding to the pixel rows to which these display signals are inputted. Accordingly, the scanning state selection signal 114-3 which is transferred to the scanning driver 103-3 performs a so-called gate line selection for every one line which sequentially outputs the scanning signal for every one line of the gate lines G513 to G516 in response to the scanning clock CL3 (for every outputting of the gate pulse a single time). Accordingly, the display signal L513 is supplied to the pixel rows corresponding to the gate line G513 over one horizontal period (defined by the pulse interval of the horizontal clock CL1). Then, the display signal L514 is supplied to the pixel rows corresponding to the gate line G514 over one horizontal period. Subsequently, the display signal L515 is supplied to the pixel rows corresponding to the gate line G515 over one horizontal period. Finally, the display signal L516 is supplied to the pixel rows corresponding to the gate line G516 over one horizontal period.

On the other hand, in the above-mentioned second step, which follows the first step, and in which these display signals L513 to L516 are sequentially outputted for every horizontal period (in response to the pulse of the horizontal clock CL1), the blanking signal B is outputted in one horizontal period which follows 4 horizontal periods corresponding to the first step. In this embodiment, the blanking signal B which is outputted between outputting of the display signal L516 and outputting of the display signal L517 is supplied to respective pixel rows corresponding to the group of gate lines G5 to G8. Accordingly, the scanning driver 103-1 is required to perform a so-called 4-line simultaneous gate-line selection which applies the scanning signal to all 4 lines of the gate lines G5 to G8 within the outputting period of the blanking signal B. However, in the display operation of the pixel array according to FIG. 4, as mentioned above, although the scanning driver 103 starts the application of a scanning signal to only one gate line in response to the scanning clock CL3 (for the pulse generated a single time), the scanning driver 103 does not start the application of a scanning signal to a plurality of gate lines. That is, the scanning driver 103 does not simultaneously rise the scanning signal pulses for a plurality of gate lines.

Accordingly, the scanning state selection signal 114-1 transferred to the scanning driver 103-1 applies the scanning signal to at least (Z−1) lines out of Z lines of gate lines to which the scanning signal is to be applied before outputting the blanking signal B, and controls the scanning driver 103-1 such that the application time of the scanning signal (pulse width of the scanning signal) is prolonged to a period which is at least N times as long as the horizontal period. These variables Z, N are the selection number: Z of gate lines in the second step and the outputting number: N of display signals in the first step, which were described in the explanation of the first step for writing the image data to the pixel array and the second step for writing the blanking data to the pixel array. For example, scanning signals are respectively applied to the gate lines G5 to G8 in the following manner. That is, the scanning signal is supplied to the gate line G5 from an outputting start time of the display signal L514 over a period which is 5 times as long as the horizontal period. The scanning signal is supplied to the gate line G6 from an outputting start time of the display signal L515 over a period which is 5 times as long as the horizontal period. The scanning signal is supplied to the gate line G7 from an outputting start time of the display signal L516 over a period which is 5 times as long as the horizontal period. The scanning signal is supplied to the gate line G8 from an outputting completion time of the display signal L516 (outputting start time of the blanking signal B which follows the gate line G8) over a period which is 5 times as long as the horizontal period. That is, although the respective rise times of the gate pulses of a group of gate lines G5 to G8 due to the scanning driver 103 are sequentially shifted for every one horizontal period in response to the scanning clock CL3, by delaying the respective falling times of the respective gate pulses after N horizontal periods of the rise time, all of the gate pulses of the groups of gate lines G5 to G8 are made to assume a state in which the gate pulses rise (High in FIG. 4) during the above-mentioned blanking signal outputting period. In controlling the outputting of the gate pulses in this manner, it is preferable to make the scanning driver 103 have a shift register operational function. Here, the hatched regions indicated in the gate pulses of the gate lines G1 to G12 in which the blanking signal is supplied to the corresponding pixel rows will be explained later.

On the other hand, between this period (the above-mentioned first step in which the display signals L513 to L516 are outputted) and the second step, which follows the first step, the display signals are not supplied to the pixel rows which correspond to the group of gate lines G257 to G512 which receive the scanning signals from the scanning driver 103-2. Accordingly, the scanning state selection signal 114-2, which is transferred to the scanning driver 103-2, makes the scanning clock CL3 ineffective for the scanning driver 103-2 during the period extending over the first step and the second step. Such an operation to make the scanning clock CL3 ineffective using the scanning state selection signal 114 is applicable at a given timing to a case in which the display signals and the blanking signals are supplied to the group of pixels within the region to which the scanning signals are outputted from the scanning driver 103 to which the scanning state selection signal 114-2 is transferred. In FIG. 4, the waveform of the scanning clock CL3 corresponding to the scanning signal output from the scanning driver 103-1 is shown. Although the pulse of the scanning clock CL3 is generated in response to the pulse of the horizontal clock CL1 which defines an output of the interval of the display signal and the blanking signal, the pulses are not generated at the output start time of the display signals L513, L517 . . . . In this manner, the operation to make the scanning clock CL3 transferred to the scanning driver 103 from the display control circuit 104 ineffective at a specific time can be performed using the scanning state selection signal 114. The operation to make the scanning clock CL3 partially ineffective for the scanning driver 103 may be performed such that a signal processing path corresponding to the scanning clock CL3 is incorporated in the scanning driver 103 and the operation of the signal processing path may be started in response to the scanning state selection signal 114 transferred to the scanning driver 103. Here, although not shown in FIG. 4, the scanning driver 103-3 which controls writing of the image data to the pixel array also becomes dead for the scanning clock LC3 at the outputting start time of the blanking signal B. Accordingly, it is possible to prevent the scanning driver 103-3 from erroneously supplying the blanking signal to the pixel rows to which the display signals based on the image data are supplied in the first step, which follows the second step, due to outputting of the blanking signal B.

Next, the scanning state selection signals 114 make the pulses of the scanning signals (gate pulses) which are sequentially generated in the regions which the scanning state selection signals 114 respectively control ineffective at a stage in which the gate pulses are outputted to the gate lines. This function, in the driving method of the display device shown in FIG. 4, causes the scanning state selection signal 114 to be transferred to the scanning driver 103 concerned with the signal processing inside the scanning driver 103 which supplies the blanking signal to the pixel array. Three waveforms DISP1, DISP2, DISP3 shown in FIG. 4 are those of the scanning state selection signals 114-1, 114-2, 114-3 which are concerned with the signal processing inside the respective scanning drivers 103-1, 103-2, 103-3. When these waveforms DISP1, DISP2, DISP3 are at Low-level, outputting of the gate pulse becomes effective. Further, the waveform DISP1 of the scanning state selection signal 114-1 assumes the High-level during the period in which the display signals are outputted to the pixel array in the above-mentioned first step so as to make outputting of the gate pulse generated by the scanning driver 103-1 during this period ineffective.

For example, the gate pulses which are generated on the scanning signals respectively corresponding to the gate lines G1 to G7 during 4 horizontal periods in which the display signals L513 to L516 are supplied to the pixel array have the respective outputs thereof made ineffective as indicated by hatching in response to the scanning state selection signal DISP1, which assumes the High-level during this period. Accordingly, it is possible to prevent the display signals based on the image data from being erroneously supplied to the pixel rows to which the blanking signals are to be supplied during a certain period, and, hence, the blanking display due to these pixel rows (erasing of images displayed in these pixel rows) can be surely performed and, at the same time, the loss of intensity of the display signals based on the image data per se can be prevented. Further, during one horizontal period which outputs the blanking signal B and is arranged between 4 horizontal periods which output the display signals L513 to L516 and next 4 horizontal periods which output the display signals L517 to L520, the scanning state selection signal DISP1 assumes the Low-level. Accordingly, the gate pulses which are generated on the scanning signals corresponding to respective gate lines G5 to G8 during these periods are collectively outputted to the pixel array, the pixel rows corresponding to these gate lines consisting of 4 lines are simultaneously selected, and the blanking signals B are supplied to the respective pixel rows.

As described above, in the display operation of the display device shown in FIG. 4, based on the scanning state selection signals 114, it is possible to determine not only the operational state of the scanning driver 103 to which the scanning state selection signal 114 is transferred (the operational state of either one of the above-mentioned first step and the above-mentioned second step or the non-operational state which depends on neither of them), but also the validity of outputting of the gate pulses generated by the scanning driver 103 in response to these operational states. Here, a series of controls of the scanning driver 103 (outputting of scanning signals from the scanning driver 103) based on these scanning state selection signals 114 are started from outputting of the scanning signal to the gate line G1 in response to the scanning start signal FLM with respect to both the writing of the display signals based on the image data to the pixel array and the writing of the blanking signals. FIG. 4 mainly shows the line selection operation (4 line simultaneous selection operation) of the gate lines using the scanning driver 103 which is sequentially shifted by the scanning state selection signal DISP1 in response to the above-mentioned second pulse of the scanning start signal FLM. Although not shown in FIG. 4, due to the operation of the display device in response to the scanning state selection signal DISP1, the selection operation of gate line for every one line using the scanning driver 103 is sequentially shifted in response to the first pulse of the scanning start signals FLM. Accordingly, also in the operation of the display device shown in FIG. 4, it is necessary to start scanning of two types of the pixel arrays a single time for each in response to the scanning start signal FLM for every frame period, and, hence, as the waveform of the scanning start signal FLM, the first pulse and the second pulse, which follows the first pulse, appear.

In both of the above-mentioned driving methods of the display device shown in FIG. 1 and FIG. 4, the number of the scanning drivers 103 which are arranged along one side of the pixel array 101 and the number of scanning state selection signals 114 which are transmitted to the scanning drivers 103 can be changed without changing the structure of the pixel array 101, which has been explained in conjunction with FIG. 3 and FIG. 9, wherein respective functions which are shared by three scanning drivers 103 may be collectively held by one scanning driver 103 (for example, the inside of the scanning driver 103 is divided into circuit sections respectively corresponding to the above-mentioned three scanning drivers 103-1, 103-2, 103-3).

FIG. 6 is a timing chart showing the image display timing of a display device of this embodiment over three continuous frame periods. At the beginning of each frame period, the writing of image data from the first scanning line SCSL (corresponding to the above-mentioned gate line G1) to the pixel array is started in response to the first pulse of the scanning start signal FLM. After a lapse of time: Δt1 from this point of time, the writing of the blanking data from the first scanning line to the pixel array is started in response to the second pulse of the scanning start signal FLM. Further, after a lapse of time: Δt2 from the point of time that the second pulse of the scanning start signal FLM is generated, writing of image data to be inputted to the display device to the pixel array in the next frame period is started in response to the first pulse of the scanning start signal FLM. Here, in this embodiment, time: Δt1' shown in FIG. 6 is equal to the time: Δt1 and time: Δt2' shown in FIG. 6 is equal to time Δt2. With respect to the advance of writing of image data PCD to the pixel array and the advance of writing of the blanking data BLD, although they differ in the number of lines (the former: one line the latter: 4 lines) of gate lines which they select during one horizontal period, these writings advance substantially equally with respect to the lapse of time. Accordingly, irrespective of the positions of the scanning lines in the pixel array, the period that the pixel rows which correspond to respective scanning lines hold display signals based on the image data (substantially covering the above-mentioned time Δt1: including time for receiving the display signals) and the period in which the pixel rows hold the blanking signal (substantially covering the above-mentioned time: Δt2 including time for receiving the blanking signal) become substantially uniform over the vertical direction of the pixel array. That is, the irregularities of display luminance between the pixel rows (along the vertical direction) in the pixel array can be suppressed. In this embodiment, 67% and 33% of one frame are respectively allocated to the display period of the image data in the pixel array and the display period of the blanking data, as shown in FIG. 6, and the timing adjustment of the scanning start signal FLM corresponding to the allocation of a frame period is performed (the above-mentioned times Δt1 and Δt2 are adjusted). However, by changing the timing of the scanning start signal FLM, the display period of the image data and the display period of the blanking data can be suitably changed.

One example of the luminance response of the pixel rows, when the display devices is operated at the image display timing shown in FIG. 6, is shown in FIG. 7. In this luminance response, a liquid crystal display panel, which has the resolution of WXGA class and is operated in the normally black display mode, is used as the pixel array 101 shown in FIG. 3, and display ON data, which results in a display of the pixel rows in white, are written in the pixel rows as the image data, while display OFF data which results in a display of the pixel rows in black, are written in the pixel rows as blanking data. Accordingly, the luminance response shown in FIG. 7 shows the change of optical transmissivity of the liquid crystal layer corresponding to the pixel rows of the liquid crystal display panel. As shown in FIG. 7, the pixel rows (each pixel included in these pixel rows), during one frame period, respond to the luminance corresponding to the image data first of all and, thereafter, respond to the black luminance. Although the optical transmissivity of the liquid crystal layer responds to a change of the electric field applied to the liquid crystal layer relatively gradually, as clearly understood from FIG. 7, the value of the optical transmissivity sufficiently responds to the electric field corresponding to the image data PCD for every frame period FRAME and an electric field corresponding to the blanking data BCD. Accordingly, with respect to an image due to image data generated on the screen (pixel rows) during the frame period, the image is sufficiently erased from the screen (pixel rows) within the frame period, and, hence, the image is displayed in the same state as an impulse type display device. Due to such an impulse-type response of the image based on the image data, blurring of an animated image, which is generated on the image, can be reduced. Such an advantageous effect can be obtained in the same manner by changing the resolution of the pixel array or by changing the rate of the retrace period in the horizontal period of the driver data shown in FIG. 2.

In the above-mentioned embodiment, in the first step, the display signals, which are generated for every one line of image data, are sequentially outputted to the pixel array four times and are respectively sequentially supplied to the pixel row corresponding to one line of the gate lines, and in the succeeding second step, the blanking signals are sequentially outputted to the pixel array a single time and are supplied to the pixel rows corresponding to 4 of the gate lines. However, the outputting number: N (this value also corresponding to the number of line data written in the pixel array) of the display signals in the first step is not limited to 4, while the outputting number: M of the blanking signals in the second step is not limited to 1. Further, the line number: Y of the gate lines to which the scanning signals (selection pulses) are applied for single outputting of the display signals in the first step is not limited to 1, while the line numbers: Z of the gate lines to which the scanning signal is applied for the single blanking signal output in the second step is not limited to 4. These factors N, M are required to be natural numbers which satisfy the condition that M<N and N is required to be 2 or more. Further, it is also required that the factor Y is a natural number smaller than N/M and the factor Z is a natural number equal to or greater than N/M. Still further, one cycle in which N-time display signal outputting and M-time blanking signal outputting are performed is completed within a period in which N-line image data are inputted to the display device. That is, the value which is (N+M) times as large as the horizontal period in the operation of the pixel array is set to a value equal to or smaller than the value which is N times as large as the horizontal scanning period in the inputting of the image data to the display device. The former horizontal period is defined by the pulse interval of the horizontal clock CL1, while the latter horizontal scanning period is defined by the pulse interval of the horizontal synchronizing signal HSYNC which constitutes one of the video control signals.

According to such operational conditions of the pixel array, during the period Tin in which N-line image data are inputted to the display device, the (N+M) times signal outputting from the data driver 102 is performed, that is, the pixel array operation of one cycle consisting of the first step and the second step, which follows the first step, is performed. Accordingly, the time (referred to as Tinvention hereinafter) allocated respectively to outputting of display signals and outputting of blanking signals in this one cycle is reduced to a value which is (N/(N+M)) times as large as the time (referred to as Tprior hereinafter) necessary for outputting signal a single time for sequentially outputting the display signal corresponding to the N-line image data during the period Tin. However, since the factor M is a natural number smaller than N, according to the present invention, the outputting period Tinvention of the present invention, in which signals during one cycle are outputted, can ensure a length which is equal to or longer than ½ of the above-mentioned Tprior. That is, from a viewpoint of writing the image data to the pixel array, an advantageous effect described in the above-mentioned SID 01 Digest, pages 994 to 997 is obtained relative to a technique described in the above-mentioned Japanese Unexamined Patent Publication 2001-166280.

Further, according to the present invention, by supplying the blanking signals to the pixels during the period Tinvention, it is possible to rapidly lower the luminance of the pixel. Accordingly, compared to the technique described in SID 01 Digest, pages 994 to 997, according to the present invention, the video display period and the blanking display period of each pixel row during one frame period can be clearly divided, and, hence, the motion blur can be efficiently reduced. Further, in accordance with the present invention, although the supply of the blanking signals to the pixels is performed intermittently every (N+M) times, the blanking signals can be supplied to the pixel row corresponding to Z-line gate lines with respect to 1-time blanking signal outputting, and, hence, irregularities of the ratio between the video display period and the blanking display period, which are generated between the pixel rows, can be suppressed. Further, by sequentially applying the scanning signal to the gate line every other Z line of the gate lines for every outputting of the blanking signal, the load for single outputting of the blanking signal from the data driver 102 also can be reduced due to the restriction on the number of pixel rows to which the blanking signal is supplied.

Accordingly, the driving of the display device according to the present invention is not limited to the example which has been explained in conjunction with FIG. 1 to FIG. 7 and in which N is set to 4, M is set to 1 and Z is set to 4. That is, so long as the above-mentioned conditions are satisfied, the driving of the display device according to the present invention is universally applicable to the driving of a hold-type display device. For example, when the image data are inputted to the display device using an interlace method through either one of odd-numbered lines and even-numbered lines for every frame period, the image data of the odd-numbered lines or the even-numbered lines are sequentially applied for every one line and the scanning signals are sequentially applied for every 2 lines of gate lines, and the display signals may be supplied to the pixel rows corresponding to them (in this case, at least the above-mentioned factor Y assuming 2). Further, in the driving of the display device according to the present invention, the frequency of the horizontal clock CL1 is set to a value which is ((N+M)/N) times (1.25 times in the examples shown in FIG. 1 and FIG. 4) as large as the frequency of the horizontal synchronizing signal HSYNC. However, the frequency of the horizontal clock CL1 may be increased further so as to narrow the pulse interval and to ensure the operational margin of the pixel array. In this case, a pulse oscillation circuit may be provided to or in the vicinity of the display control circuit 104, and, hence, the frequency of the horizontal clock CL1 may be increased in conjunction with the reference signal having a frequency higher than that of a dot clock DOTCLK included in the video control signals generated by the pulse oscillation circuit.

With respect to the above-mentioned respective factors, the factor N may preferably be set to the natural number of 4 or more, while the factor M may preferably be set to 1. Further, the factor Y may preferably take the equal value as the factor M, while the factor Z may preferably take the equal value as the factor N.

Second Embodiment

In this embodiment, in the same manner as the above-mentioned first embodiment, with respect to the image data which are inputted to the display device shown in FIG. 3 at the timing shown in FIG. 2, the display signals and the scanning signals are outputted from the data driver 102 with the waveforms shown in FIG. 1 or FIG. 4, and a display is produced in accordance with the display timing shown in FIG. 6. However, in this embodiment, the output timing of the blanking signals with respect to the outputting of the display signals based on the image data shown in FIG. 1 and FIG. 4 is changed every frame period, as shown in FIG. 8.

Figure 8:
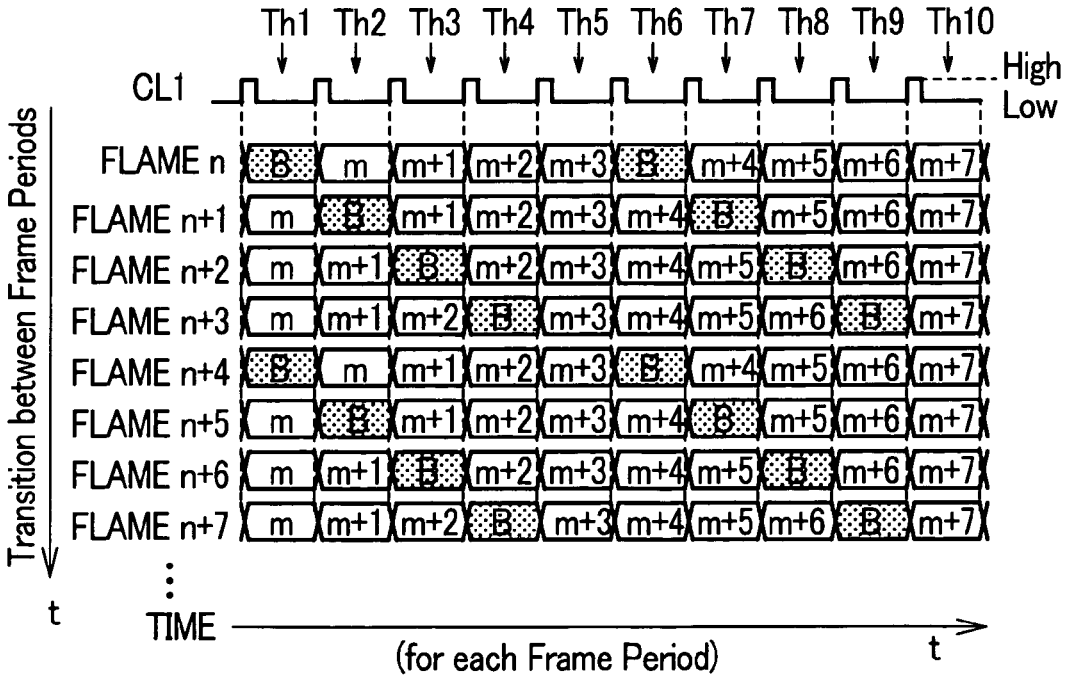
FIG. 8 is a diagram showing the change of display signals (m, m+1, m+2, . . . based on video data and B based on a blanking data) supplied to respective pixel rows corresponding to gate lines G1, G2, G3, . . . over a plurality of continuous frame periods n, n+1, n+2, . . . in a second embodiment of the method of driving the liquid crystal display device according to the present invention.

In the display device using a liquid crystal display panel as the pixel array, the output timing of the blanking signals of this embodiment shown in FIG. 8 has an advantageous effect in that the influence of rounding of waveforms of the signals generated in the data lines of the liquid crystal display panel to which the blanking signals are supplied can be dispersed, whereby the display quality of the image can be enhanced. In FIG. 8, periods Th1, Th2, Th3, . . . which respectively correspond to pulses of the horizontal clock CL1 are sequentially arranged in the lateral direction, and, in any one of these periods, eye diagrams, each of which includes the display signals m, m+1, m+2, m+3, . . . for every one line of the image data outputted from the data driver 102 and the blanking signal B, are sequentially arranged in the longitudinal direction for every one of continuous frame periods n, n+1, n+2, n+3, . . . . The display signals m, m+1, m+2, m+3 described in connection with this embodiment are not limited to the image data of specific lines, and, for example, they can be used as the display signals L1, L2, L3, L4 as well as the display signals L511, L512, L513, L514 in FIG. 1.

Every time the image data are written in the pixel array four times in the manner explained in conjunction with the first embodiment, the blanking data are written in the pixel array a single time. In this case, the periods in which the blanking data are applied to the pixel array shown in FIG. 8 are sequentially changed for every frame from any one of a group of periods (for example, a group consisting of the periods Th1, Th6, Th12, . . . ) which are arranged every 4 other periods in the above-mentioned periods Th1, Th2, Th3, Th4, Th5, Th6, . . . to another group of periods (for example, a group consisting of periods Th2, Th7, Th13, . . . ). For example, in the frame period n, before inputting the mth line data into the pixel array (before applying the display signal based on the mth line data to the mth pixel row), the blanking data are inputted to the pixel array (the blanking data are applied to the pixel row corresponding to the given 4 lines of the gate lines). In the frame period n+1, after inputting the mth line data into the pixel array and before inputting the (m+1)th line data into the pixel array, the above-mentioned blanking data are inputted to the pixel array. Inputting of the (m+1)th line data to the pixel array follows that of the mth line data and the display signal based on the (m+1)th line data is applied to the (m+1)th pixel row. In succeeding inputting of respective line data to the pixel array, the display signal based on the line data is applied to the pixel row having the same address (order) as the line data.

In the frame period n+2, after inputting the (m+1)th line data into the pixel array and before inputting the (m+2)th line data into the pixel array, the blanking data are inputted to the pixel array. In the subsequent frame period n+3, after inputting the (m+2)th line data into the pixel array and before inputting the (m+3)th line data into the pixel array, the blanking data are inputted to the pixel array. Thereafter, such inputting of the line data and the blanking data to the pixel array is repeated by shifting or deviating the timing of the blanking data every one horizontal period, and, in the frame period n+4, the inputting returns to the input pattern of the line data and the blanking data to the pixel array in the frame period n. By repeating a series of operations, the influence of the rounding of the signal waveforms which are generated along the extending direction of data line, when not only the blanking signal but also the display signal based on the line data are outputted to respective data lines of the pixel array, can be uniformly dispersed so that the quality of image displayed on the pixel array can be enhanced.

Also in this embodiment, in the same manner as the first embodiment, the display device can be operated at the image display timing shown in FIG. 6. In this embodiment, however, since the timing for applying the blanking signal to the pixel array is shifted every frame period, as mentioned above, the point of time for generating the second pulse of the scanning start signal FLM which starts scanning of the pixel array by the blanking signal is deviated corresponding to the frame period. Corresponding to the change of the second pulse generating timing of the scanning start signal FLM, the time: Δt1 indicated in the frame period 1 in FIG. 6 becomes the time: Δt1' which is shorter (or longer) than the time: Δt1 in the succeeding frame period 2, and the time: Δt2 indicated in the frame period 1 becomes the time: Δt2' which is longer (or shorter) than the time: Δt2 in the succeeding frame period 2. To consider "the deviation" of the scanning start time of the pixel array on the display signals based on the line data m which is observed between a pair of frame periods n and n+1 and between another pair of frame periods n+3 and n+4 shown in FIG. 8, in this embodiment, at least one of two time intervals: Δt1, Δt2 corresponding to the pulse interval of the scanning start signal FLM is changed in response to the frame period.

As described above, when the display operation is performed following the image display timing shown in FIG. 6 in accordance with the driving method of the display device according to this embodiment, which shifts the outputting period of the blanking signal along the time axis direction for every frame period, some change is necessary in setting the scanning start signal. However, the advantageous effects obtained by this embodiment are almost comparable to the advantageous effects obtained by the first embodiment shown in FIG. 7. Accordingly, also in this embodiment, the image corresponding to the image data can be displayed on the hold-type display device substantially in the same manner as the impulse-type display device. Further, compared to the hold-type pixel array, the animated images do not undesirably affect the luminance, and, hence, it is possible to produce a display while reducing the motion blur generated in the animated image. Also in this embodiment, the ratio between the display period of image data and the display period of blanking data during one frame period can be suitably changed by adjusting the timing of the scanning start signal FLM (for example, the distribution of the above-mentioned pulse intervals: Δt1, Δt2). Further, the applicable range of the driving method of this embodiment to the display device is not limited, as in the case of the driving method of the first embodiment, by the resolution of the pixel array (for example, liquid crystal display panel). Still further, in the display device according to this embodiment, in the same manner as the display device of the first embodiment, by suitably changing the ratio of the retrace period included in the horizontal period defined by the horizontal clock CL1, the outputting number: N of display signals in the first step and the line number: Z of the gate lines selected by the second step can be increased or decreased.

Third Embodiment

As has been explained in conjunction with the above-mentioned first embodiment, the video data of the image in one frame period is sequentially inputted to the display device by dividing the plurality of line data contained in the video data with the cycle (horizontal scanning period), which is defined by the horizontal synchronizing signal HSYNC.

That is, the video data (line data) for one line is stored in the memory circuit (line memory) 105 in response to the above-mentioned horizontal synchronizing signal HSYNC, and the reading-out of the video data is performed with the horizontal clock CL1 constituted of the cycle (horizontal period) which is generated by shortening the retracing period included in the above-mentioned horizontal synchronizing signal HSYNC.

Then, in the first embodiment, the generation of the horizontal clock CL1 uses the horizontal synchronizing signal HSYNC as a reference and is carried out such that an arbitrary value is decoded from a counter which counts the clock number for N horizontal periods with respect to the horizontal synchronizing signal HSYNC thus generating the (N+1) horizontal periods including the blanking data. However, the above-mentioned decoded arbitrary value assumes, when the display device 100 is incorporated into a personal computer, for example, a value matched to the personal computer, that is, a fixed value, and, hence, when the video data containing the above-mentioned horizontal synchronizing signal HSYNC is data from an external video signal source, such as a television receiver set, a DVD player or the like, for example, a drawback which will be explained hereinafter is found.

Figure 10:
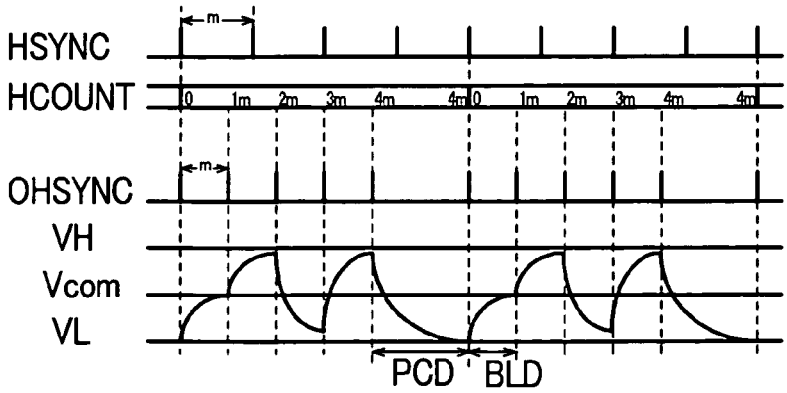
FIG. 10 is a diagram which show drawbacks in the above-mentioned respective embodiments and also is a timing chart showing voltage waveforms of a pixel obtained on the basis of a horizontal synchronizing signal HSYNC contained in video data supplied from an external video signal source.

FIG. 10 shows a timing chart of voltage waveforms of the pixel, which waveforms are obtained based on the horizontal synchronizing signal HSYNC contained in the video data from the external video signal source. Here, in the same manner as the above-mentioned embodiment, the following explanation to an example in which the number of rows: Y of the pixel rows which are selected in the first selection step in response to a single outputting of the display signal in the first step is 1, the number of outputs: N of the display signal in the first step is 4, the number of rows: Z of the pixel rows which are selected in the second selection step in response to a single outputting of the display signal in the second step is 4, and the number of outputs: M of the display signal in the second step is 1.

HSYNC in FIG. 10 indicates the above-mentioned horizontal synchronizing signal and implies that pulses are generated every n times. HCOUNT is a counter value which corresponds to the clock number for N horizontal periods and is counted by a counter from a point of time that the blanking data are supplied with respect to the horizontal synchronizing signal HSYNC and the count value is indicated by 0, m, 2m, 3m and 4m. Here, the value of m is a fixed value determined as 4/5 ($\Delta t_{LCM}$) and ($\Delta t_{LCM}$) is a value based on an inner clock incorporated into the inside of the display device 100. OHSYNC is an output horizontal synchronizing that is signal generated on the various of the above-mentioned count value and corresponds to the above-mentioned horizontal clock CL1. Vcom indicates a waveform of the voltage supplied to the pixel. That is, Vcom indicates a waveform of the voltage applied to the pixel electrode PX using a voltage supplied to the counter electrode CT as a reference.

As can be understood from this drawing, when the output horizontal synchronizing signal OHSYNC is obtained based on the fixed value 4/5 ($\Delta t_{LCM}$) irrespective of the fact that the time n corresponding to a width between respective pulses of the horizontal synchronizing signal HSYNC is changed, the value of the horizontal period m for supplying display data in a step preceding the supply of the blanking data becomes larger than other horizontal periods, for example, thus giving rise to a drawback that the writing time of the pixel at such a portion is increased.

Accordingly, when a viewer observers the display surface of the display device 100, the line corresponding to the pixel at such a portion becomes relatively bright and eventually is recognized as a lateral stripe.

Figure 11:
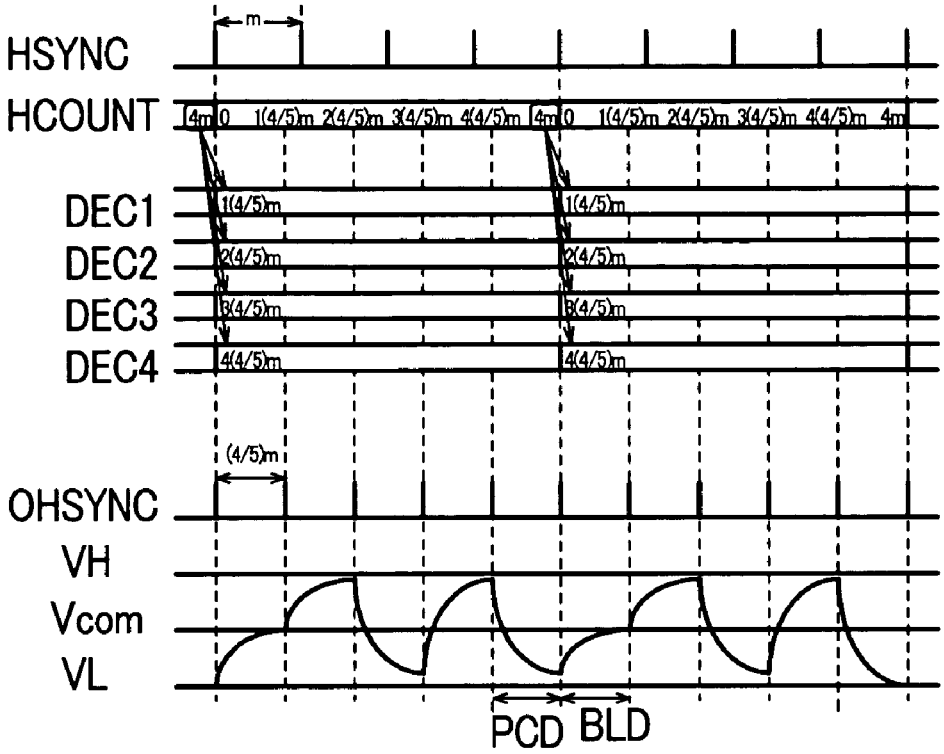
FIG. 11 is a diagram which shows another embodiment of the display device according to the present invention and also is a timing chart showing voltage waveforms of a pixel obtained on the basis of a horizontal synchronizing signal HSYNC contained in video data supplied from an external video signal source.

FIG. 11 is a view showing another embodiment of the display device which overcomes the above-mentioned drawback and corresponds to FIG. 10.

In FIG. 11, HSYNC indicates the above-mentioned horizontal synchronizing signal and implies that the pulse is generated every n times. Here, the value of n may differ depending on an external video signal source. HCOUNT is a counter value which corresponds to the clock number for (N+1) horizontal periods and is counted by a counter from a point of time that the blanking data are supplied with respect to the horizontal synchronizing signal HSYNC. In FIG. 11, as the count value, values 0, (4/5)n, 2(4/5)n, 3(4/5)n, 4(4/5)n corresponding to decode values DEC1, DEC2, DEC3, DEC4 to be described later are indicated. DEC1, DEC2, DEC3, DEC4 indicate the respective calculated decode values 1, 2, 3, 4 which are obtained by evenly dividing 4 horizontal scanning periods (one horizontal scanning period corresponding to n) of the above-mentioned horizontal synchronizing signal HSYNC into five sections. Here, the decode value 1 is (4/5)n, the decode value 2 is 2(4/5)n, the decode value 3 is 3(4/5)n and the decode value 4 is 4(4/5)n. In this case, even at the time of supplying the next blanking data from a point of time that the blanking data are supplied, the respective decode values 1, 2, 3, 4 are calculated by evenly dividing 4 horizontal scanning periods of the above-mentioned horizontal synchronizing signal HSYNC into five sections at such a point of time. This provision is provided for instantaneously coping with the change of the horizontal synchronizing signal HSYNC contained in the video data. OHSYNC is an output horizontal synchronizing signal generated on the basis of the above-mentioned respective decode values 1, 2, 3, 4 and corresponds to the above-mentioned horizontal clock CL1. Vcom indicates a waveform of a voltage supplied to the pixel. That is, Vcom indicates a waveform of a voltage applied to the pixel electrode PX using a voltage supplied to the counter electrode CT as a reference.

Figure 12:
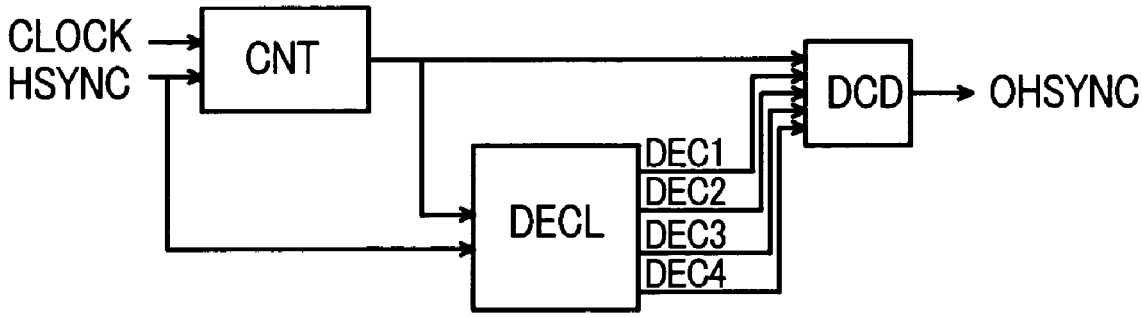
FIG. 12 is a block diagram showing a circuit for executing the operations indicated by the timing chart shown in FIG. 11.

Further, FIG. 12 shows one example of the circuit constitution for enabling the above-mentioned operations, wherein the circuit is formed in a state in which the circuit is incorporated into the above-mentioned display control circuit 104.

In FIG. 12, of the video data from the external video signal source, the horizontal synchronizing signal HSYNC and the clock signal CLOCK, which is synchronous with the horizontal synchronizing signal HSYNC, are inputted to a 4 horizontal counter CNT. The above-mentioned clock signal CLOCK is counted by the 4 horizontal counter CNT and the count value is inputted to a decode value calculation circuit DECL and a decoding circuit DCD, respectively.

To the decode value calculation circuit DECL, the horizontal synchronizing signal HSYNC is also inputted besides the above-mentioned count value, and the decode value calculation circuit DECL calculates the respective decode values 1, 2, 3, 4 obtained by evenly dividing 4 horizontal scanning periods of the above-mentioned horizontal synchronizing signal HSYNC into five sections respectively as (4/5)n, 2(4/5)n, 3(4/5)n, 4(4/5)n. Further, these decode values 1, 2, 3, 4 are inputted to the decoding circuit DCD.

The decoding circuit DCD generates the output horizontal synchronizing signal OHSYNC based on the counter values from the 4 horizontal counter CNT and the respective decode values 1, 2, 3, 4.

With a display device having such a constitution, even when the time n corresponding to the width between respective pulses of the horizontal synchronizing signal HSYNC becomes different, the 4 horizontal periods can be evenly divided into five sections so that writing time of the pixel can be made uniform. Accordingly, when a viewer observes the display surface of the display device 100, it is possible to obtain a favorable image while preventing the occurrence of lateral stripes or the like.

Here, in the above-mentioned embodiment, the explanation will be directed to an example in which the number of rows: Y of the pixel rows which are selected in the first selection step in response to a single outputting of the display signal in the first step is 1, the number of outputs: N of the display signal in the first step is 4, the number of rows: Z of the pixel rows which are selected in the second selection step in response to a single outputting of the display signal in the second step is 4, and the number of outputs: M of the display signal in the second step is 1. However, it is needless to say that the number of rows: Y of the pixel rows which are selected in the first selection step in response to a single outputting of the display signal in the first step may be set to a natural number smaller than N/M, the number of outputs: N of the display signal in the first step may be set to a natural number of 2 or more, the number of rows: Z of the pixel rows which are selected in the second selection step in response to a single outputting of the display signal in the second step may be set to a natural number equal to or more than N/M, and the number of outputs: M of the display signal in the second step may be set to a natural number smaller than N.

In this case, the outputting of N pieces of display signals in the first step and the outputting of M-pieces of display signals in the second step may be performed in response to a period obtained by evenly dividing N-times horizontal scanning period which are sequentially outputted into (N+M) sections.

The above-mentioned respective embodiments may be used in a single form or in combination. This is because the advantageous effects of the respective embodiments may be obtained in a single form or in a synergistic manner.

As can be clearly understood from the foregoing explanation, according to the display device of the present invention, even when the video data which is inputted to the display device is changed, it is possible to prevent the degradation of the display quality.

What is claimed is:

1. A display device comprising a pixel array in which a plurality of pixel rows each of which includes a plurality of pixels arranged in parallel along the first direction are arranged in parallel along the second direction which intersects the first direction, a scanning driver circuit which selects the plurality of respective pixel rows in response to a scanning signal, a data driver circuit which supplies a display signal to the respective pixels included in at least one row selected in response to the scanning signal out of the plurality of pixel rows, and a display control circuit which controls a display operation of the pixel array, wherein lines of image data are inputted to the data driver circuit one after another for every horizontal scanning period of the video data, the data driver circuit alternately repeats (i) a first step for generating a display signal corresponding to each one of the lines of the video data sequentially for every fixed period and outputting the display signal to the pixel array N-times (N being a natural number equal to or greater than 2) and (ii) a second step for generating a display signal which makes the luminance of the pixels lower than the luminance of the pixel in the first step for the fixed period and outputting the display signal to the pixel array M-times (M being a natural number smaller than N), the scanning driver circuit alternately repeats (i) a first selection step for selecting the plurality of pixel rows for every Y rows (Y being a natural number smaller than the N/M) sequentially from one end to another end of the pixel array along the second direction in the first step and (ii) a second selection step for selecting the plurality of pixel rows other than the pixel rows (Y×N) selected in the first selection step for every Z rows (Z being a natural number not smaller than N/M) sequentially from one end to another end of the pixel array along the second direction in the second step, and the outputting of N pieces of display signals in the first step and the outputting of M pieces of display signals in the second step are performed in response to periods which are obtained by evenly dividing the N-pieces of the horizontal scanning periods which are sequentially outputted into (N+M) pieces of periods.

2. A display device according to claim 1, wherein the number of rows: Y of the pixel rows which are selected in the first selection step in response to a single outputting of the display signal in the first step is 1, the number of outputs: N of the display signal in the first step is 4 or more, the number of rows: Z of the pixel rows which are selected in the second selection step in response to a single outputting of the display signal in the second step is 4 or more, and the number of outputs: M of the display signal in the second step is 1.

3. A display device comprising a pixel array in which a plurality of pixel rows each of which includes a plurality of pixels arranged in parallel along the first direction are arranged in parallel along the second direction which intersects the first direction, a scanning driver circuit which selects the plurality of respective pixel rows in response to a scanning signal, a data driver circuit which supplies a display signal to the respective pixels included in at least one row selected in response to the scanning signal out of the plurality of pixel rows, and a display control circuit which controls a display operation of the pixel array, wherein lines of image data are inputted to the data driver circuit one after another for every horizontal scanning period of the video data, the data driver circuit alternately repeats (i) a first step for generating a display signal corresponding to each one of the lines of the video data sequentially for every fixed period and outputting the display signal to the pixel array N-times (N being a natural number equal to or greater than 2) and (ii) a second step for generating a display signal which makes the luminance of the pixels lower than the luminance of the pixel in the first step for the fixed period and outputting the display signal to the pixel array M-times (M being a natural number smaller than N), the scanning driver circuit alternately repeats (i) a first selection step for selecting the plurality of pixel rows for every Y rows (Y being a natural number smaller than the N/M) sequentially from one end to another end of the pixel array along the second direction in the first step and (ii) a second selection step for selecting the plurality of pixel rows other than the pixel rows (Y×N) selected in the first selection step for every Z rows (Z being a natural number not smaller than NIM) sequentially from one end to another end of the pixel array along the second direction in the second step, and the outputting of N pieces of display signals in the first step and the outputting of M pieces of display signals in the second step are performed in response to periods which are obtained by evenly dividing the N-pieces of the horizontal scanning periods which are sequentially inputted to the display control circuit into (N+M) pieces of periods.

4. A display device according to claim 3, wherein the number of rows: Y of the pixel rows which are selected in the first selection step in response to a single outputting of the display signal in the first step is 1, the number of outputs: N of the display signal in the first step is 4 or more, the number of rows: Z of the pixel rows which are selected in the second selection step in response to a single outputting of the display signal in the second step is 4 or more, and the number of outputs: M of the display signal in the second step is 1.

5. A display device according to claim 3, wherein the circuit generates a horizontal synchronizing signal which is corrected by a horizontal counter which allows inputting of a horizontal synchronizing signal and a clock signal contained in an external video signal source therein, a decode value calculation circuit which allows inputting of the horizontal synchronizing signal and a count value from the horizontal counter and a decoding circuit to which each decode value from the decode calculation circuit and the counter value from the horizontal counter are inputted.

6. A display device according to either one of claim 3 or claim 5, wherein the circuit is incorporated into the display control circuit.

7. A display device comprising a pixel array having a plurality of pixels which are arranged in the row direction as well as in the column direction, a scanning driver circuit and a data driver circuit which are connected to the pixel array, and a display control circuit which is connected to the scanning driver circuit and the data driver circuit;

the data driver circuit alternately repeats i) a first step which outputs a display signal corresponding to video data supplied from the display control circuit to the pixel array by an amount corresponding to N rows (N being a natural number not smaller than 2) and a second step which outputs a display signal corresponding to luminance equal to or less than luminance corresponding to the display signal outputted in the first step by an amount corresponding to M rows (M being a natural number smaller than N), and the scanning driver circuit alternately repeats (i) a first selection step for sequentially selecting every Y rows of the pixel array in the first step and (ii) a second selection step for selecting every Z pixel rows other than the pixel rows selected in the first selection step in the second step, and a time for one row in outputting the display signal for N rows in the first step is equal to a time for one row in outputting the display signal for M rows in the second step.

8. A display device according to claim 7, wherein a time obtained by dividing the outputting time of the display signal for N rows in the first step by N is equal to a time obtained by dividing the outputting time of the display signal for M rows in the second step by M.

9. A display device according to claim 7, wherein a time for outputting the display signal of respective rows for N rows in the first step is equal to a time for one row in outputting the display signal for M rows in the second step.

10. A display device according to claim 7, wherein the outputting of the display signal for N rows in the first step and the outputting of the display signal for M rows in the second step are performed in response to a period obtained by equally dividing a horizontal scanning period by (N+M) for the N rows which is inputted to the display control circuit.

11. A display device according to claim 7, wherein the number of rows: Y of the pixel rows which are selected in the first selection step is 1, the number of outputs: N of the display signal in the first step is 4 or more, the number of rows: Z of the pixel rows which are selected in the second selection step in response to a single outputting of the display signal in the second step is 4 or more, and the number of outputs: M of the display signal in the second step is 1.

* * * * *